US006279487B1

(12) United States Patent
Gaydos et al.

(10) Patent No.: US 6,279,487 B1
(45) **Date of Patent: *Aug. 28, 2001**

(54) RAILROAD HOPPER CAR DOOR ASSEMBLY

(75) Inventors: Christopher C. Gaydos, St. Charles; Robert T. Fischer, Homewood; Guadalupe L. Galvan, DeKalb, all of IL (US)

(73) Assignee: Miner Enterprises, Inc., DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/444,930

(22) Filed: Nov. 22, 1999

Related U.S. Application Data

(63) Continuation-in-part of application No. 09/088,569, filed on Jun. 2, 1998.

(51) Int. Cl.[7] ..... B61D 3/00

(52) U.S. Cl. ..... 105/289; 105/250; 105/299

(58) Field of Search ..... 105/289, 250, 105/299, 248, 240, 279, 280, 284, 286, 287, 288, 290, 296, 311.1, 313, 253, 282.1

(56) References Cited

U.S. PATENT DOCUMENTS

| | | | | |
|---|---|---|---|---|
| 3,161,146 | * | 12/1964 | Lutts, Sr. et al. | 105/240 |
| 3,182,954 | * | 5/1965 | Borger | 105/240 |
| 3,385,231 | * | 5/1968 | Dorey | 105/250 |
| 3,408,956 | * | 11/1968 | Rebenok et al. | 105/240 |
| 3,501,030 | * | 3/1970 | Flink | 105/240 |
| 3,611,947 | * | 10/1971 | Nagy | 105/253 |
| 3,772,996 | * | 11/1973 | Schuller | 105/240 |
| 3,818,842 | * | 6/1974 | Heap | 105/240 |
| 4,232,989 | * | 11/1980 | Miller | 105/251 |
| 5,163,372 | * | 11/1992 | Galvan et al. | 105/240 |
| 5,261,333 | * | 11/1993 | Miller | 105/287 |
| 5,606,916 | * | 3/1997 | Murray | 105/286 |
| 6,019,049 | * | 2/2000 | Gaydos et al. | 105/289 |

* cited by examiner

*Primary Examiner*—S. Joseph Morano
*Assistant Examiner*—Lars A. Olson
(74) *Attorney, Agent, or Firm*—John W. Harbst

(57) ABSTRACT

An apparatus for controlling discharge of material from a bottom dump railroad car having a centersill defining a longitudinal axis for the hopper car is disclosed. The apparatus includes a plurality of longitudinally mounted discharge door assemblies. Each door assembly comprises a pair of longitudinally mounted discharge doors disposed to opposite lateral sides of the longitudinal axis of the car for movement between open and closed positions relative to respective discharge openings on a bottom of the car. Each discharge door is mounted for movement about an axis disposed adjacent and extending generally parallel to the longitudinal axis of the car. A door operating mechanism including a positively driven actuator is carried on the hopper car for operating at least one of the discharge door assemblies independently of at least one other discharge door assembly on the car. The door operating mechanism includes a primary lock for inhibiting inadvertent movement of the discharge doors of each door assembly to an open position. A secondary lock, operable in timed relation to the door operating mechanism, is disclosed for releasably maintaining the discharge doors of each discharge door assembly in a closed position.

26 Claims, 13 Drawing Sheets

FIG. 9
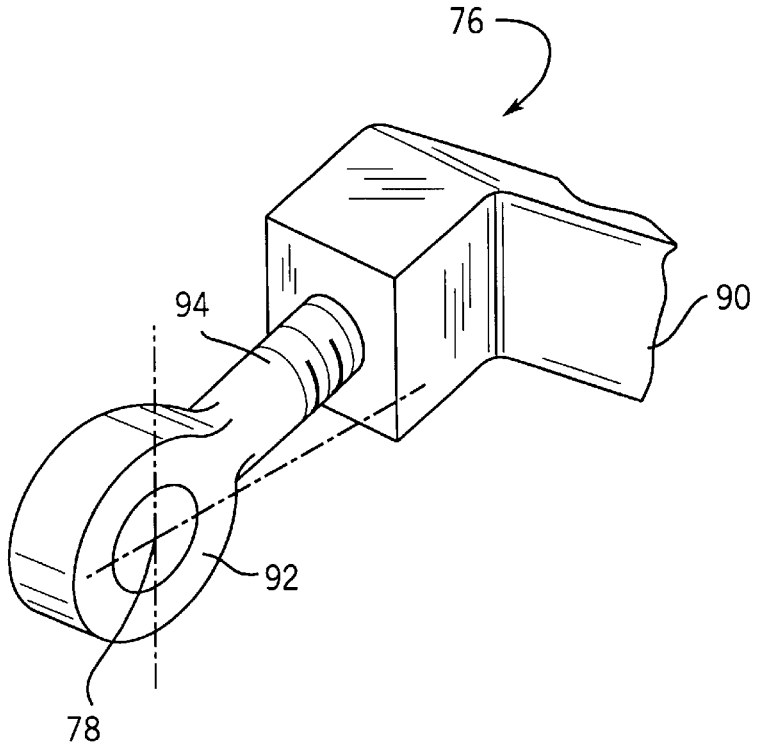
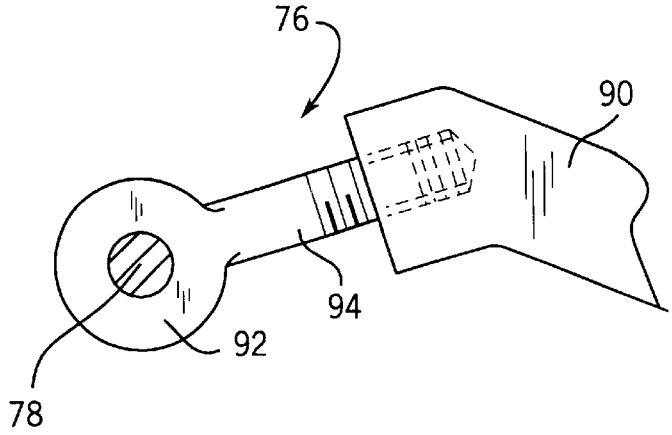
FIG. 10

RAILROAD HOPPER CAR DOOR ASSEMBLY

RELATED APPLICATION

This patent application is a continuation-in-part of copending and coassigned U.S. patent application Ser. No. 09/088,569 filed Jun. 2, 1998.

FIELD OF THE INVENTION

The present invention generally relates to hopper cars and, more particularly, to a door assembly mounted longitudinally to a bottom of a railroad hopper car to control the discharge of ballast and/or particulate matter from the hopper car.

BACKGROUND OF THE INVENTION

Railroad hopper cars are provided with a plurality of designs but typically include a walled enclosure mounted on an underframe of the car. As is conventional, the underframe of the car is supported toward opposite ends thereof by the usual wheeled trucks which ride on tracks or rails. A bottom of the walled enclosure is usually provided with a series, typically one or more, of individual discharge openings for allowing the particulate matter held and transported within the enclosure to be discharged therefrom. The walled enclosure furthermore usually includes sloped or slanted walls or sheets extending upwardly from the periphery of each discharge opening to promote gravitational movements of the particulate matter toward the openings.

Various methods and devices are known in the art for individually closing the plurality of discharge openings in the walled enclosure of the hopper car. A slide gate mechanism is typically used in combination with each individual discharge opening on the hopper car. A conventional slide gate mechanism or device includes a frame which is bolted or otherwise connected to the walled enclosure on the hopper car. The frame defines an opening which, when the gate is assembled to the hopper car, is in registry with the discharge opening on the hopper car thereby permitting particulate matter to pass therethrough. A gate is arranged on the frame for sliding movement between open and closed positions relative to the discharge opening. When open, the gate permits the contents of the hopper car to gravitationally pass from the car. When closed, the sliding gate shuts off material flow through the gate. Typically, the gate is slidably driven between positions through an operating shaft assembly rotatably mounted on the frame and including a conventional rack and pinion. As will be appreciated by those skilled in the art, opposite ends of the operating shaft assembly are engagable by a power driven tool to drive the gate between positions.

Alternatively, a door assembly, extending generally transverse to the longitudinal axis of the railroad hopper car, is used to control the discharge of material from the walled enclosure. Such a door assembly is well known in the art and typically includes one or more doors mounted in combination relative to each discharge opening on the underside of the hopper car. Each door is configured to swing between open and closed positions about an axis extending generally transverse to the longitudinal axis of the hopper car. Accordingly, such known door assembly designs are limited to the width or transverse dimension of the walled enclosure of the railroad hopper car.

Existing unloading sites usually have two parallel and adjacent unloading pits that are about 36 to 40 feet in length and a yard having a capacity for storing a relatively large number of railroad hopper cars. The unloading area is typically sheltered from rain and snow and the railroad cars are spotted over the unloading pits by using two car pullers (one for each track). Locomotives are used to move the hopper cars into range of the spotters and the railroad hopper cars are usually stationary during the unloading process. When the slide gate mechanisms are opened, an operator is required to use one of three portable power drivers or tools to independently operate the sliding gate associated with each discharge opening on the railroad car. Preferably, the discharge of material from the hopper car is limited to between the tracks since any material dropped on the rails has the potential for causing a derailment and the discharged material will be contaminated.

Unloading of the railroad hopper cars using slide gate mechanisms involves three to four persons located between the two unloading pits. This arrangement allows access to both tracks from one location using three power driven tools. As will be appreciated by those skilled in the art, each power tool has a free end configured to interface with either end of the operating shaft assembly on the slidable gate. Each tool is configured to handle a specific style of gate or gate operating handle.

Unloading of the railroad hopper cars using transversely mounted door assemblies involves unlocking a mechanism holding the door or doors of each door assembly in a closed position relative to the discharge opening. Once the mechanism used to hold the door or doors of the door assembly in a closed position is released from its locked condition, the weight of the material within the walled enclosure forcibly opens the doors thereby effecting unloading of the railroad car.

During unloading, a hatch on a top of the covered hopper car should be opened to equalize the pressure within the walled enclosure as the particulate matter or commodity passes therefrom. Although inconvenient, failure to open a hatch on the top of the hopper car can result in the car imploding during the unloading process.

As will be appreciated, unloading of covered hopper cars involves a manually intensive effort. Moreover, time is of the essence. In view of future demands, unloading sites are preparing for quicker and easier ways to unload the hopper cars and convey the particulate matter or ballast away from the unloading pits. Some sites are preparing their unloading procedures such that the hopper cars can be unloaded while on the move rather than remaining stationary.

Thus, there is a need and a desire for a door assembly for hopper cars which allows the particulate matter stored and transported within the walled enclosure of the hopper car to be discharged rapidly from the hopper cars and between the rails with minimum operator intervention.

SUMMARY OF THE INVENTION

In view of the above, a primary object of this invention is to provide an apparatus comprised of a plurality of door assemblies for a hopper car which allows for rapid discharge of material held within a walled enclosure on the hopper car. The hopper car is provided with an underframe extending longitudinally of the car. As is conventional, the underframe of the hopper car is supported, toward opposite ends thereof, by wheels which ride on rails or tracks. Moreover, and as is typical, the walled enclosure on the hopper car defines two or more discharge openings through which material is discharged from the walled enclosure.

Each discharge opening of the walled enclosure on the hopper car has a discharge door assembly arranged in operable combination therewith for controlling the flow of material from the walled enclosure. Each door assembly is operable between open and closed positions. In a preferred form of the invention, each door assembly includes a pair of discharge doors longitudinally mounted to the underframe and on opposite lateral sides of the longitudinal axis of the hopper car for controlling discharge of particulate matter or material from the hopper car as a function of their position. In the illustrated form of the invention, each longitudinally mounted door is pivotally attached to the underframe of the hopper car adjacent the longitudinal centerline of the hopper car thereby promoting the discharge pattern of particulate material to an area or pattern between the wheels of the hopper car and, thus, within the width of the tracks.

Each discharge door of the door assembly is preferably provided with seal structure. The seal structure on each door preferably extends about the periphery thereof and operates in combination with the hopper car to seal closed the discharge door when moved into a closed position thereby inhibiting moisture and debris from contaminating the commodity or particulate matter transported and held within the hopper car. In a preferred form, each discharge door is furthermore provided with a vertically upturned lip extending about the periphery of the discharge door to further enhance the sealing capability thereof while inhibiting moisture and debris from contaminating the ballast or particulate matter held and transported within the hopper car.

In one form of the invention, a single door operating mechanism allows for all of the discharge door assemblies to be operated simultaneously relative to each other. In this form, the door operating mechanism includes an elongated actuating shaft extending generally parallel to the longitudinal axis of the hopper car. The actuating shaft is preferably mounted on the underframe of the hopper car for pivotal movement about a fixed axis. The actuating shaft is operably connected to a single driver or actuator of the door operating mechanism. In a most preferred form of the invention, the single driver or actuator of the door actuating mechanism includes a pneumatically operated cylinder carried on the hopper car.

In an alternative form of the invention, each door assembly includes an individual door operating mechanism associated therewith. That is, an individual actuator or driver is associated with and operates each door assembly. Accordingly, and in combination with a hopper car having two or more discharge openings and a door assembly associated with each discharge opening, one or more of the discharge door assemblies can be operated independently of the other door assemblies thereby controlling the flow of material from the walled enclosure.

When the door assembly on the hopper car includes discharge doors mounted to opposite lateral sides of the longitudinal axis of the car, the door operating mechanism of the present invention includes linkages radially extending in opposite directions from the actuating shaft. As will be appreciated, the free end of each linkage is operably connected to a discharge door such that upon rocking movement of the actuating shaft of the respective door operating mechanism, the discharge doors are conjointly moved in substantial unison relative to each other. In a most preferred form, the linkage for connecting the actuating shaft to each discharge door is configured as an overcenter mechanism which acts as a primary lock to inhibit the discharge doors from inadvertently opening from a closed position. Moreover, a secondary releasable lock is provided in combination with each door actuating mechanism of the present invention for inhibiting the discharge doors from inadvertently swinging open from their closed position.

The hopper car on which the door assembly is mounted is further provided with vent structure. Thus, and upon discharge of the particulate matter from the covered hopper car, ambient air is permitted to pass into the walled enclosure of the car to prevent imploding of the walls of the hopper car.

To further control the discharge of material, the hopper car is preferably provided with deflectors extending longitudinally along opposite lateral sides of the car. In combination with the advantageous pivotal mounting of the discharge doors adjacent to the longitudinal centerline of the car, the purpose of the deflectors is to limit the particulate matter discharged from the hopper car to a relatively narrow pattern disposed between the laterally spaced wheels of the car. As such, the exposure of the rails to particulate matter is advantageously reduced thereby reducing the likelihood of an inadvertent derailment due to particulate matter lying on the tracks or rails.

These and other objects, aims, and advantages of the present invention will become readily apparent from the following detailed description, the drawings and the appended claims.

BRIEF DESCRIPTION OF THE DRAWINGS

FIG. 9 is a perspective view of a portion of the linkage system forming part of the door operating mechanism;

FIG. 10 is an end elevational view of that portion of the linkage system illustrated in FIG. 9;

DETAILED DESCRIPTION OF THE INVENTION

Figure 2:
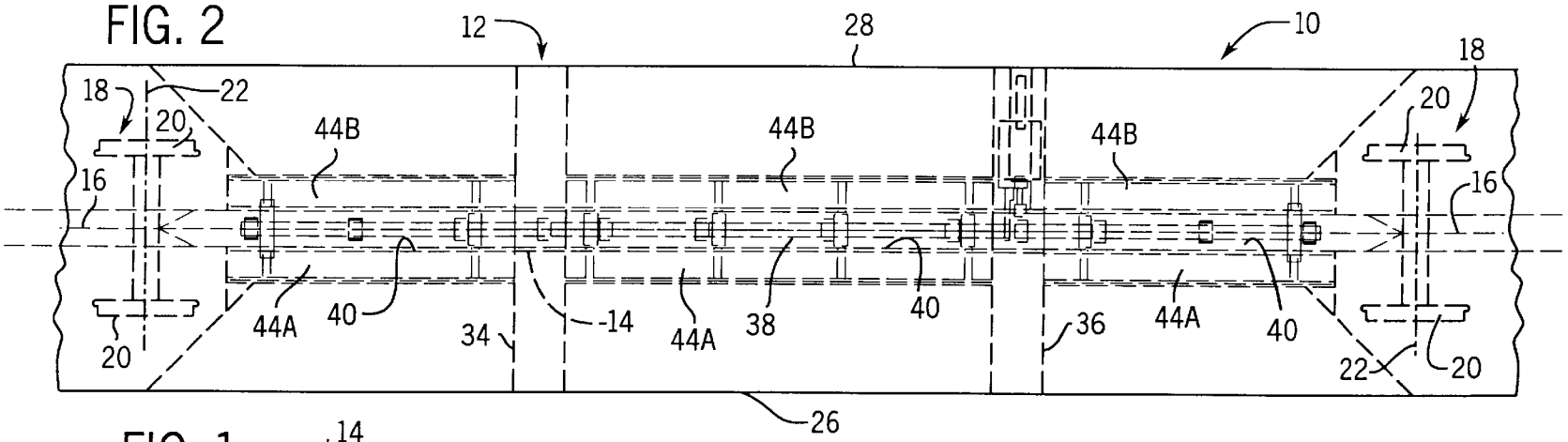
FIG. 2 is a top plan view of the hopper car illustrated in FIG. 1.

While the present invention is susceptible of embodiment in various forms, there is shown in the drawings and will, hereinafter be described preferred embodiments of the invention with the understanding the present disclosure is to be considered as setting forth exemplifications of the invention which are not intended to limit the invention to the specific embodiments illustrated.

Figure 1:
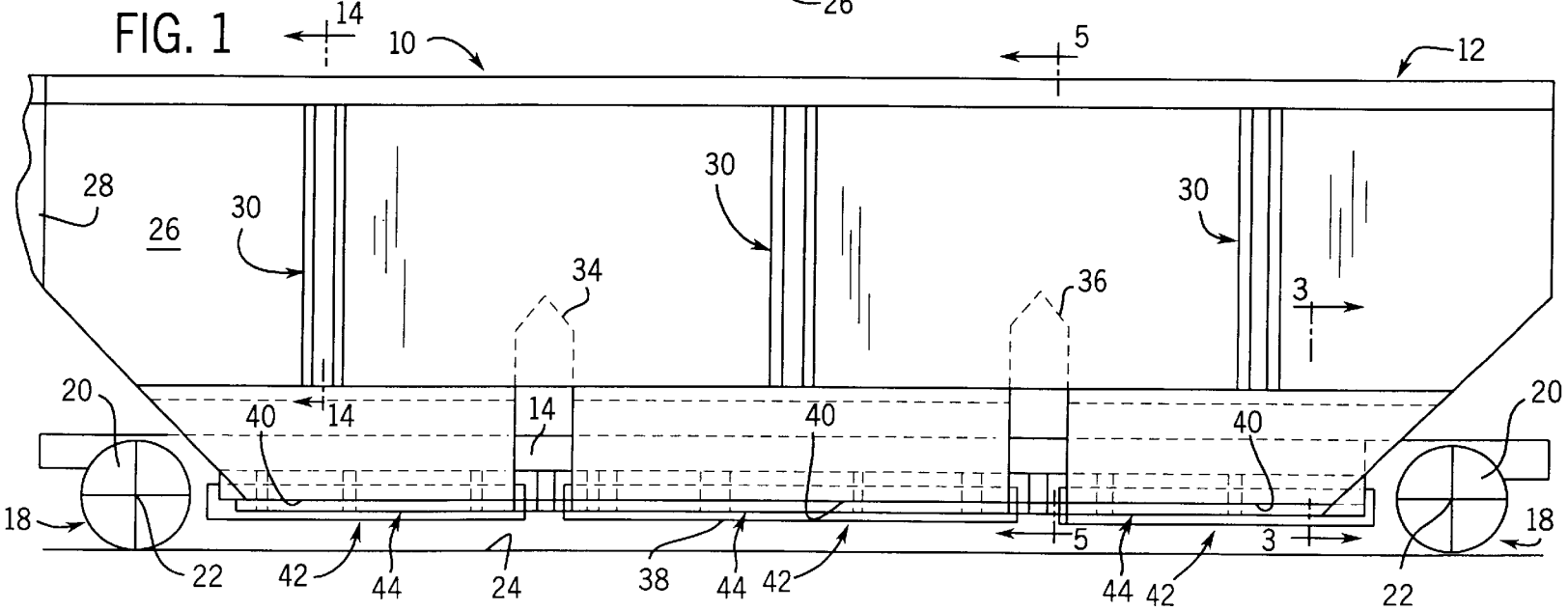
FIG. 1 is a side elevational view of a covered hopper car embodying features of the present invention.

Referring now to the drawings, wherein like reference numerals indicate like parts throughout the several views, a covered railroad hopper car, equipped with a door assembly according to one embodiment of the present invention, is somewhat diagrammatically illustrated in FIGS. 1 and 2. The covered railroad hopper car, generally designated by reference numeral 10, includes a hopper or multiwalled enclosure 12 for storing and transporting commodity or particulate matter therewithin. As is known in the art, the multiwalled enclosure 12 is supported on an underframe or centersill 14. The underframe 14 extends generally the length of and generally parallel to the longitudinal axis 16 of the car 10. As is typical, the underframe 14 is supported toward opposite ends thereof by conventional wheeled trucks, generally designated by reference numeral 18. As known in the art, each wheeled truck 18 preferably includes a pair of laterally spaced flanged wheels 20 which turn about an axis 22 extending transverse to the longitudinal axis 16 of the car 10 and which ride on laterally spaced tracks or rails 24.

As illustrated, the enclosure 12 has a generally rectangular configuration toward a top portion thereof and includes laterally spaced generally parallel side walls 26 and 28. A pair of opposed end walls 29 add to the generally rectangular configuration of the walled enclosure 12. As known in the art, a plurality of vertical side stakes or supports 30 are provided in combination with each side wall 26, 28 to add strength and rigidity thereto. In the embodiment of the railroad car shown in FIG. 5, a roof 32 is provided in combination with and serves to cover the entire walled enclosure 12. As is conventional, the roof 32 is provided with one or more covered loading openings (not shown) of any suitable type. An interior of the hopper car enclosure 12 is divided transversely by the centersill 14 and furthermore by cross ridge partitions 34 and 36 (FIG. 1).

As illustrated in FIGS. 1 and 2, a bottom 38 of the enclosure 12 is provided with a plurality of longitudinally elongated discharge openings 40 for allowing commodity or particulate matter to be discharged from the enclosure 12. In the illustrated embodiment of the invention, the longitudinally elongated discharge openings 40 are preferably arranged in pairs relative to each other on opposite lateral sides of the centersill or underframe 14.

Figure 3:
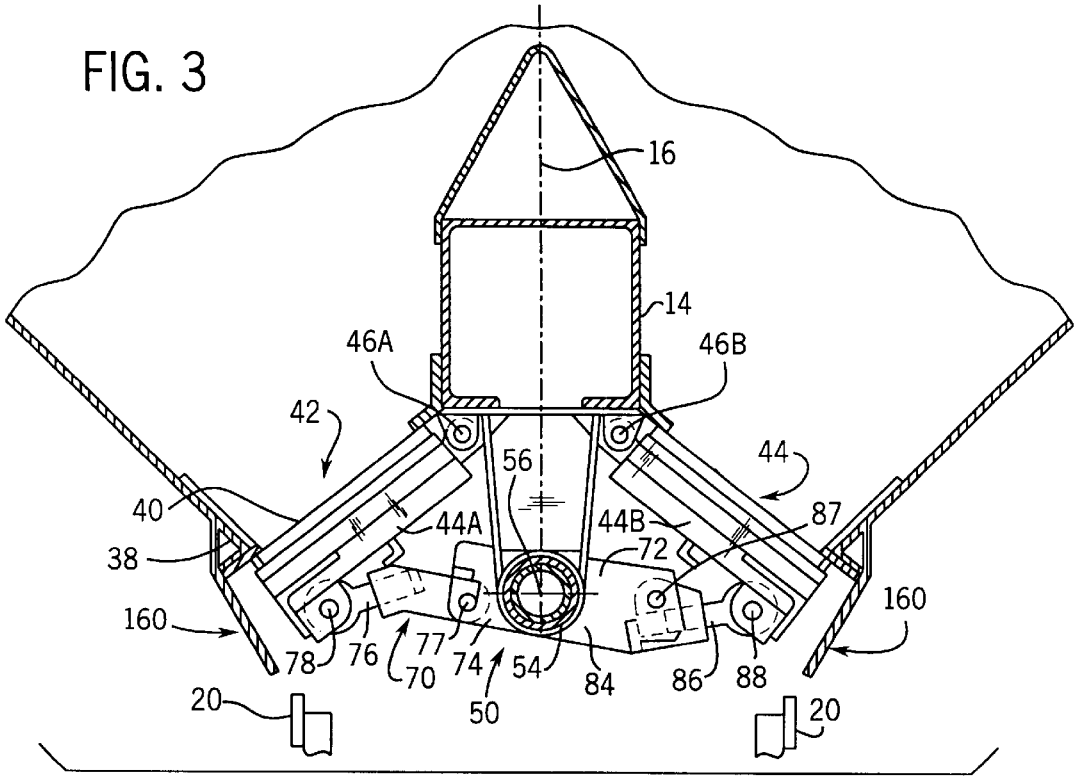
FIG. 3 is a sectional view taken along line 3—3 of FIG. 1 illustrating one form of discharge doors in a closed position.

According to this embodiment of the present invention, a door apparatus or assembly, generally designated in FIGS. 1, 2 and 3 by reference numeral 42, arranged in combination with the discharge openings 40 on the hopper car 10. As shown, door assembly 42 includes a plurality of longitudinally mounted discharge doors 44 arranged in end-to-end relation across the bottom 38 of the hopper car enclosure 12 in relation to and for controlling the discharge of particulate matter or ballast through the discharge openings 40.

Figure 4:
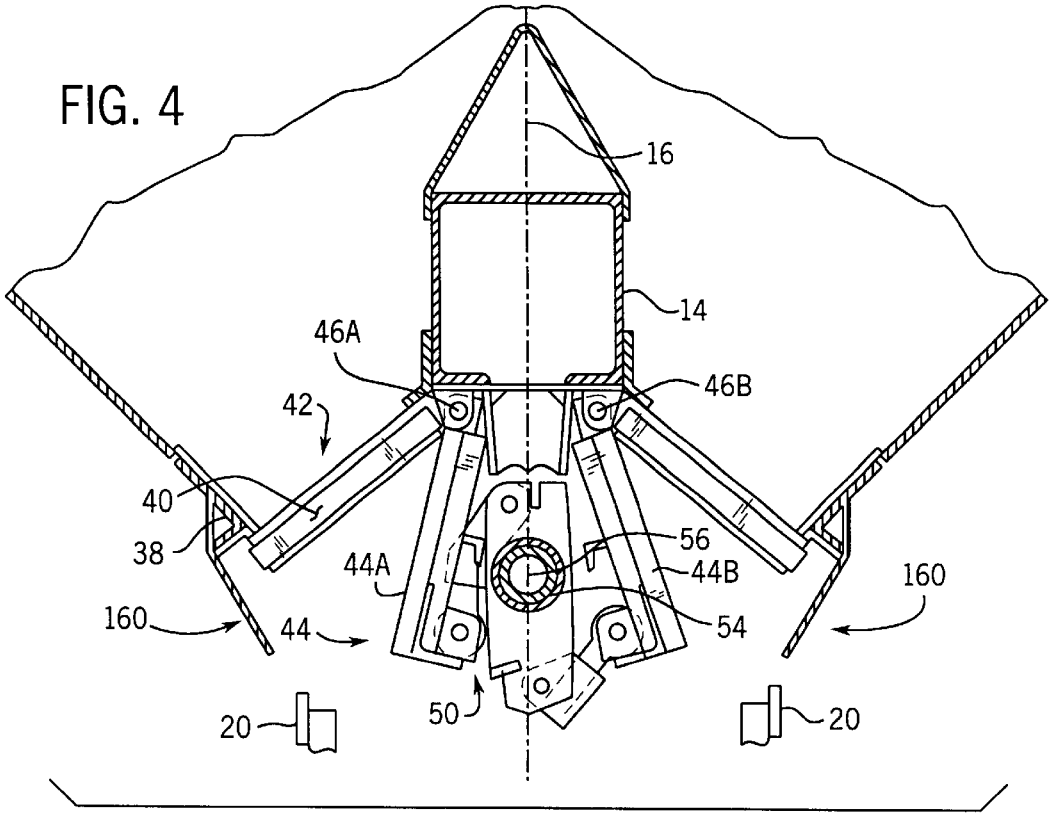
FIG. 4 is a sectional view similar to FIG. 3 but showing the discharge doors in an open position.

In a preferred form of the invention, and as shown in FIGS. 2, 3 and 4, the plurality of discharge doors 44 each preferably include divergently opening pairs of discharge doors 44A and 44B arranged on the hopper car 10 in opposed relation relative to each other. Each pair of doors 44A and 44B is mounted to the hopper car 10 for movement between a closed position (FIG. 3) and an open position (FIG. 4). As shown, each pair of doors 44A and 44B is preferably mounted to the underframe 14 adjacent the longitudinal centerline 16 of the car 10 for pivotal movement. As shown in FIGS. 3 and 4, each door 44A of the plurality of discharge doors 44 is mounted to the underframe 14 of hopper car 10 for pivotal movement about a generally horizontal axis 46A disposed generally parallel and adjacent to the longitudinal centerline 16 of the hopper car 10. Similarly, each door 44B of the plurality of discharge doors 44 is mounted to the underframe 14 of hopper car 10 for pivotal movement about a generally horizontal axis 46B disposed generally parallel and adjacent to the longitudinal centerline 16 of the hopper car 10.

In this embodiment, door assembly 42 includes a single door operating mechanism 50 for positively operating all the discharge doors 44A and 44B of the plurality of discharge doors 44 in pairs between their open and closed positions. As illustrated, the door operating mechanism 50 includes a single positively powered driver or actuator 52 (FIG. 5) for positively and conjointly operating all the doors 44A and 44B of the plurality of discharge doors 44 substantially simultaneously relative to each other. The door operating mechanism 50 furthermore includes an elongated operating or actuating shaft 54 operably connected to the single driver or actuator 52 and to each pair of doors 44A and 44B of the plurality of discharge doors 44.

Figure 5:
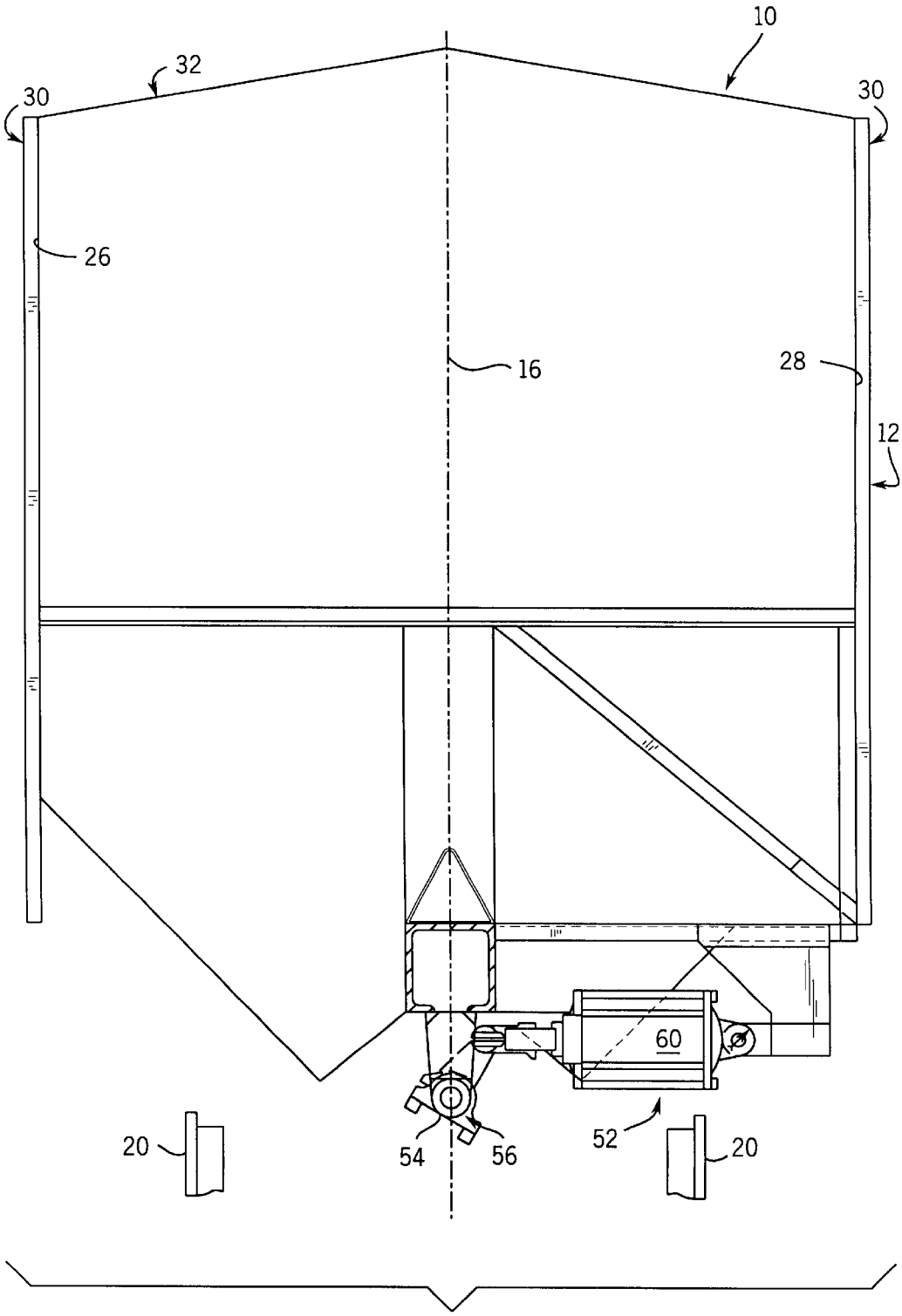
FIG. 5 is a sectional view taken along line 5—5 of FIG. 1.

In this illustrated form shown in FIGS. 3, 4 and 5, the actuating shaft 54 extends generally parallel to the longitudinal axis 16 of the hopper car 10. The actuating shaft 54 is preferably supported for rotational or rocking movement about a fixed axis 56 and is preferably supported by the underframe 14 of the hopper car 10. In a most preferred form of the invention, and to reduce its weight without effecting its strength or rigidity, the actuating shaft 54 preferably has a hollow or tubular configuration. Intermediate its ends, the actuating shaft 54 is operably coupled or connected to the actuator or driver 52.

Figure 6:
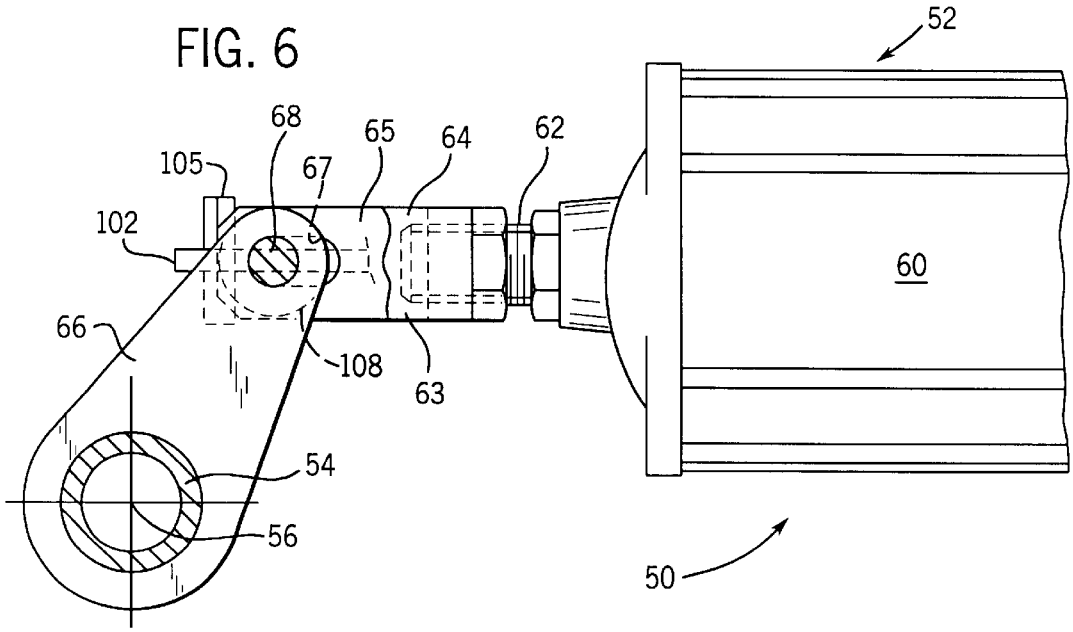
FIG. 6 is an enlarged end elevational view of a portion of one form of door operating mechanism of the present invention.
Figure 7:
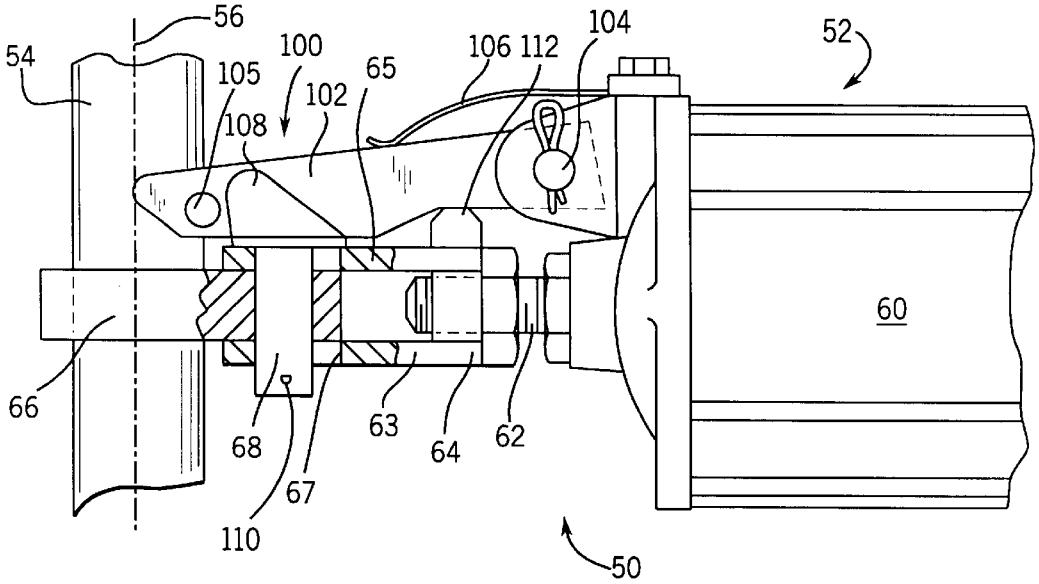
FIG. 7 is a top plan view of FIG. 6.

In the illustrated form shown in FIGS. 6 and 7, the single powered driver or actuator 52 of the door operating mechanism 50 is preferably configured as a pneumatic cylinder 60 carried by the hopper car 10 (FIG. 5) and includes a piston rod 62 extending from one end of the cylinder 60. The piston rod 62 has a ram 64 fixed secured toward a distal end thereof The ram 64 is preferably configured as a clevis with generally parallel and spaced arms 63 and 65. A lever or drive arm 66 radially extends outwardly from and is connected to the actuating shaft 54. The free end of the drive arm 66 is embraced on opposite sides by the arms 63 and 65 of ram 64. A pivot pin 68 serves to articulately interconnect the free end of the drive arm 66 to the ram 64 of actuator 52. Notably, the arms 63, 65 of ram 64 are each provided with an elongated slot 67 through which the pivot pin 68 passes thereby allowing for a predetermined degree or amount of lost motion as the pivot pin 68 traverses between opposite ends of the elongated slot 67 upon reciprocation of the ram 64. As will be appreciated, by this design, linear reciprocal movement of the piston rod 62 of driver 52 is converted to rocking movement of the actuating shaft 54 about axis 56.

Returning to FIG. 4, and in this form, the door operating mechanism 50 furthermore includes a plurality of longitudinally spaced linkages 70 for operably interconnecting the actuating shaft 54 to each pair of doors 44A and 44B of the plurality of longitudinally spaced doors 44. Preferably, the linkages 70 for operably interconnecting the actuating shaft 54 to the discharge door 44A, 44B are substantially similar. Accordingly, only one linkage 70 will be described in detail with the other linkages being understood to be of substantially similar structure.

As shown in FIGS. 3 and 4, each linkage 70 preferably includes a bell crank lever 72 secured to and for rotation with the actuating shaft 54. Notably, the bell crank lever 72 is nonrotatably secured to the actuating shaft 54. As shown, the bell crank lever 72 includes a first radial arm 74 extending radially away from the actuating shaft 54 in a first direction, generally toward the discharge door 44A, and a second radial arm 84 extending radially away from the actuating shaft 54 in a second direction, opposed to said first direction, and generally toward the discharge door 44B. A first link 76 is articulately connected, as at 77, toward a distal end of radial arm 74 of the bell crank lever 72. An opposite end of the first link 76 is articulately connected, as at 78, to the discharge door 44A. Similarly, a second link 86 is articulately connected, as at 87, toward a distal end of radial arm 84 of the bell crank lever 72. An opposite end of the second link 86 is articulately connected, as at 88, to the discharge door 44B.

Figure 8:
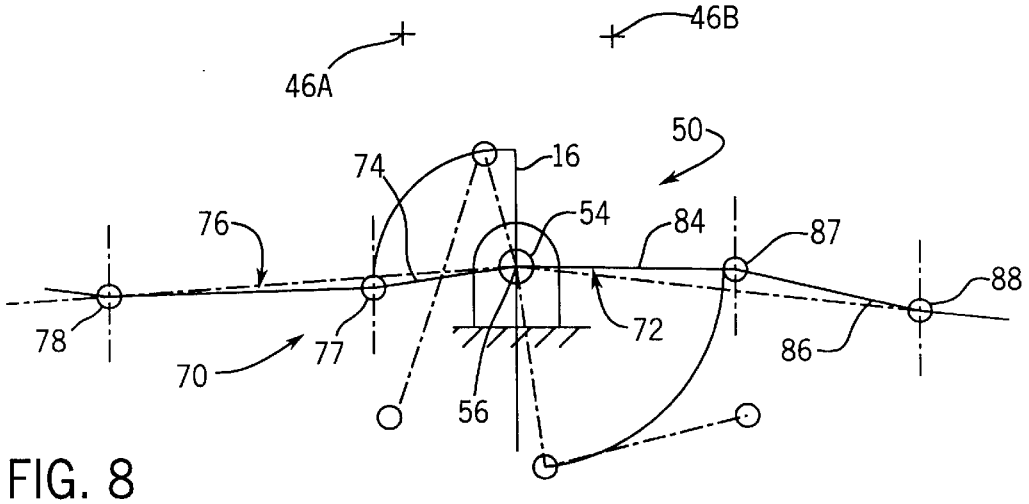
FIG. 8 is a schematic representation of a linkage system forming part of the door operating mechanism.

As schematically represented in FIG. 8, each linkage 70 is preferably configured as an overcenter linkage mechanism and acts as a primary lock for the door assembly 42. That is, when the discharge doors 44A and 44B of the door assembly 42 are closed, the radial arms 74, 84 of bell crank lever 72 and links 76, 86 assume an overcenter position between the pivotal axis 56 of the actuating shaft 54 and the respective articulated connection 78, 88 to the discharge doors 44A and 44B to positively maintain and releasably lock the discharge doors 44A, 44B of the plurality of discharge doors 44 in a closed position. Notably, the articulate interconnections 77, 87 between the radial arms 74, 84 and their respective links 76, 86, respectively, are each required to move overcenter when the discharge doors 44A, 44B of the plurality of discharge doors 44 are to be moved from their closed position to their open position.

As will be appreciated by those skilled in the art, and except for the length thereof, the first and second links 76 and 86 of each linkage 70 are of substantially similar construction. Accordingly, only link 76 will be described in detail with the understanding link 86 is substantially similar thereto. As shown in FIGS. 9 and 10, link 76 preferably is of two piece rigid construction. That is, link 76 includes a first elongated lever or member 90 configured for pivotal attachment to one of the radial arms 74, 84 of the bell crank lever 72 (FIGS. 3, 4 and 8). At its opposite end, the lever or member 90 is preferably configured for attachment to an eye bolt 92 including a finely threaded shank 94 which is threadably accommodated within the free end of lever or member 90 to thereby shorten or lengthen link 76 as required and for purposes hereinafter described in detail. The opposite end of the eye bolt 92 is articulately or pivotally connected by a suitable fastener, as at 78, to a respective discharge door 44A, 44B of the plurality of discharge doors 44.

In this form, and as illustrated in FIG. 7, the door operating mechanism 50 furthermore includes a secondary lock mechanism, generally designated by reference numeral 100, for releasably holding the pairs of doors 44A, 44B of the plurality of discharge doors 44 in their closed position. Preferably, the lock mechanism 100 is operable in combination with and is responsive to the single actuator 52 of the door operating mechanism 50.

The locking mechanism 100 shown in FIG. 7 preferably includes a lever 102 connected at one end to the actuator 52 for pivotal movement about a pin 104 carried by the pneumatic cylinder 60. The opposite end of the lever 102 is provided with a stop pin 105 arranged in transverse relation relative to the lever 102. A spring 106 serves to resiliently bias the lever 102 into the position illustrated in FIG. 7.

As shown, the pivot pin 68 for interconnecting the drive arm 62 radially extending from the actuating shaft 52 to the single actuator 52 of the door operating mechanism 50 includes an end cap 108 which straddles opposite sides of and releasably accommodates the pivotal lever 102. Notably, pivot pin 68 is maintained in place by a suitable retainer 110 arranged toward an end of the pin 68 opposite from the end cap 108. Moreover, the lock mechanism 100 includes a cam actuator 112 for properly positioning the lever 102 and the pivot pin 104 as a function of the operation of the actuator 52 of the door operating mechanism 50. In the illustrated form of lock mechanism 100, the cam actuator 112 operates in combination with an underside or surface on the lever 102.

Figure 11:
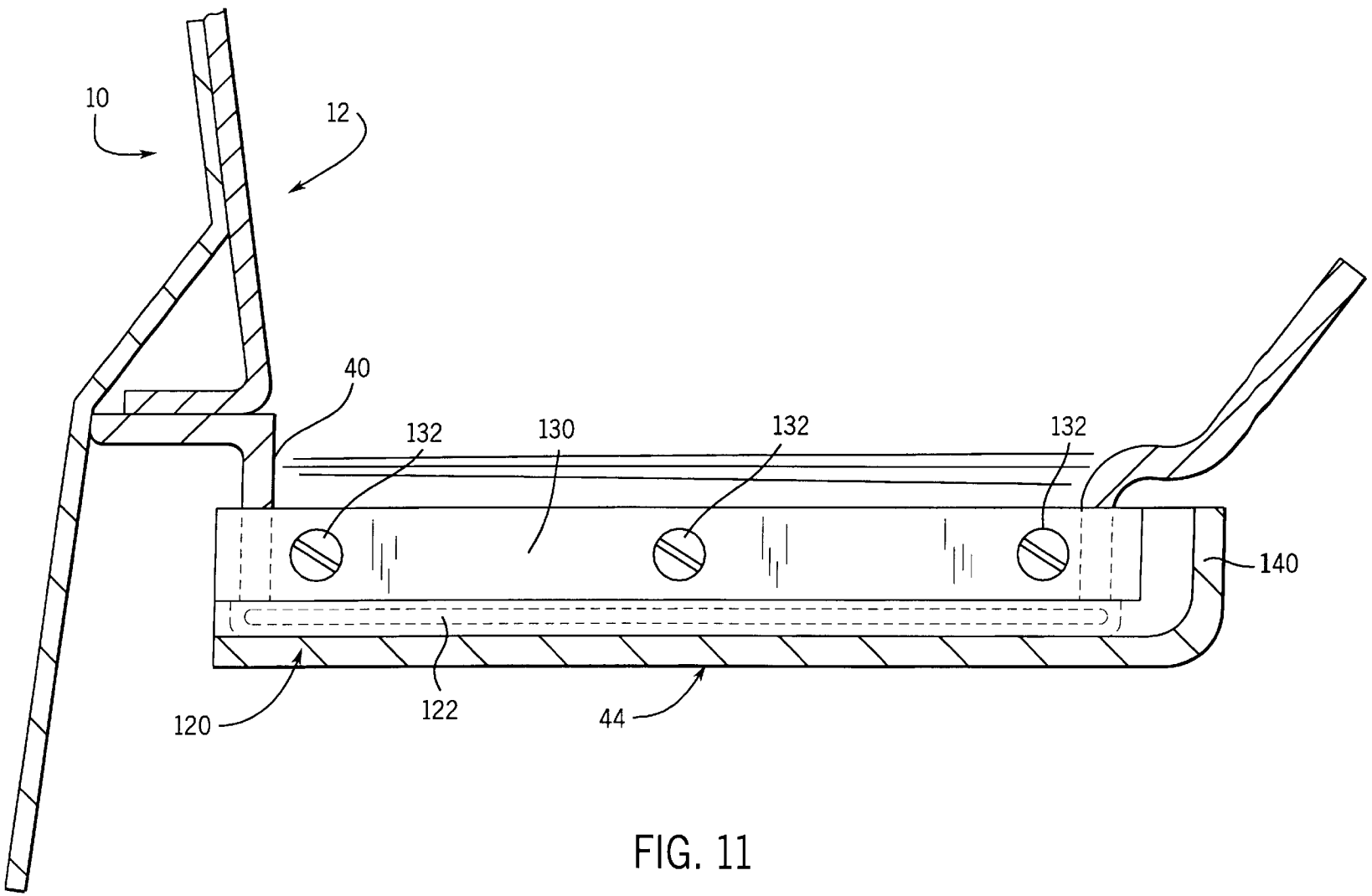
FIG. 11 is an enlarged end view of a discharge door of the present invention.
Figure 12:
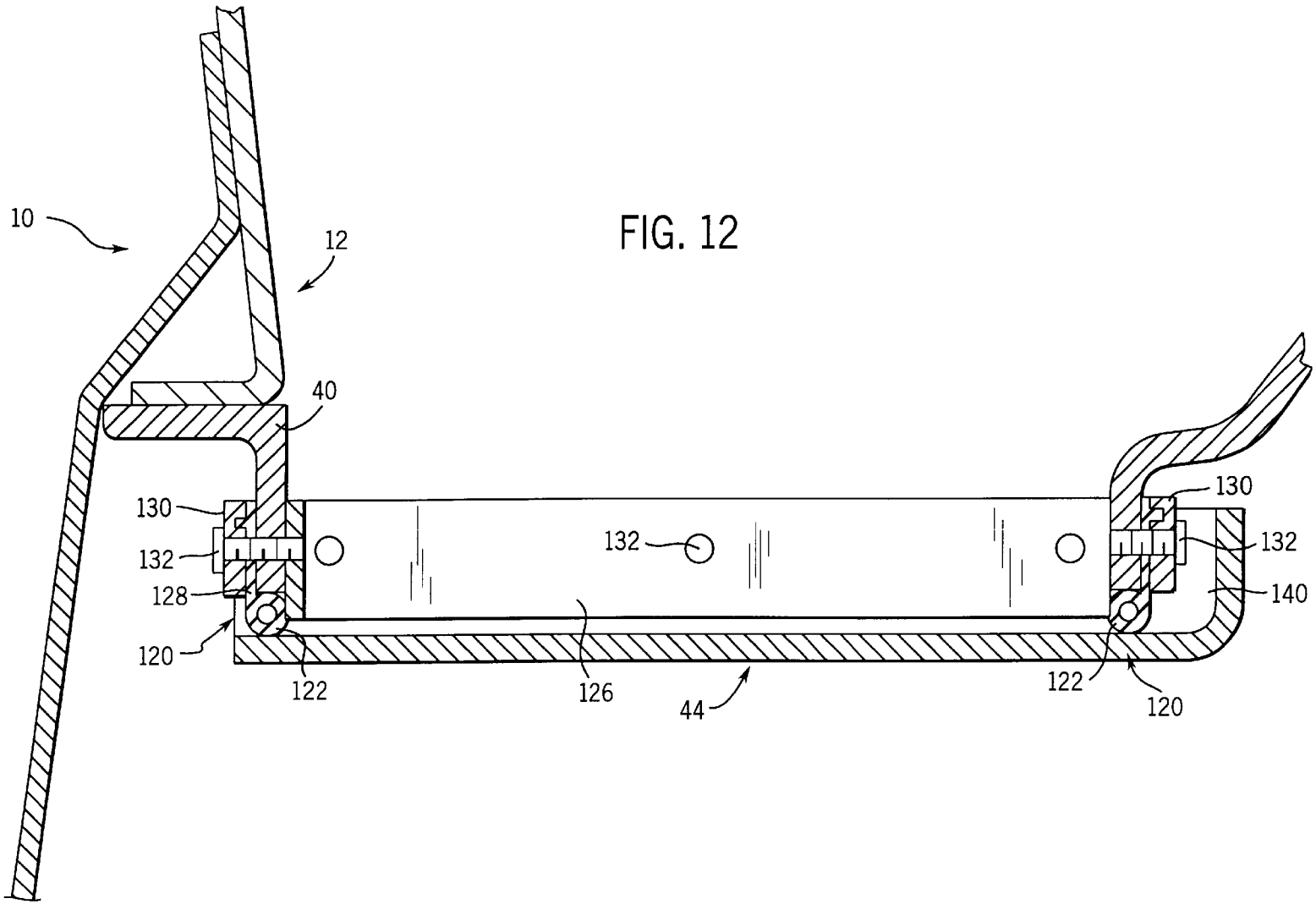
FIG. 12 is a view similar to FIG. 11 but showing certain parts in section to better appreciate and understand the preferred form of the present invention.

Preferably, each door 44A, 44B of the plurality of discharge doors 44 further includes seal structure, generally indicated by reference numeral 120, arranged about the periphery thereof for sealing closed a respective discharge door to the walled enclosure 12 of the hopper car 10. As shown in FIGS. 11 and 12, seal structure 120 includes a seal 122 mounted about the periphery of each discharge opening 40 defined by the walled enclosure 12 of hopper car 10. In a preferred form, the seal 122 is fabricated from a neoprene material having a durometer hardness of about 50 Shore A. Seal 122 preferably has a hollow configuration to enhance its sealing capability and reduce damage thereto.

As illustrated in FIG. 12, seal 122 is preferably disposed beneath the walled enclosure 12 defining each discharge opening 40. To prevent the seal 122 from being crushed when the discharge door 44 is closed, seal structure 120 further includes an inner frame 126 fixedly connected to the interior of the discharge opening 40. The inner frame 126 is formed from a rigid material such as aluminum, steel or the like. In the illustrated embodiment, and to facilitate its attachment to the walled enclosure, the inner frame 126 is of multi-piece construction.

Figure 13:
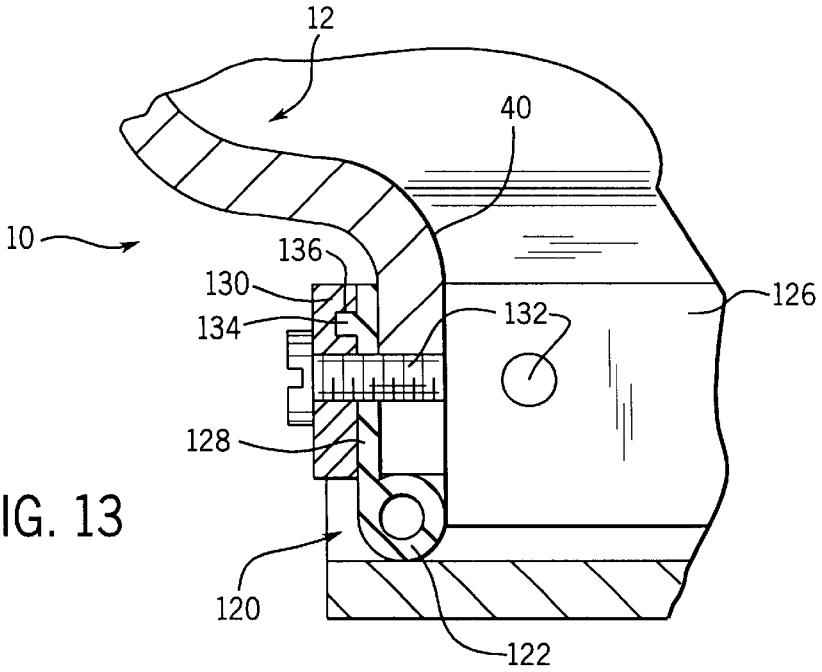
FIG. 13 is another enlarged view, partly in section, showing a portion of the sealing structure preferably associated with a discharge door of the present invention.

In the embodiment illustrated in FIGS. 12 and 13, seal 122 includes a mounting flange 128 flexibly connected to and radially extending therefrom. As shown, and when the seal 122 is attached to the walled enclosure 12 of the hopper car 10, the mounting flange 128 of seal 122 extends from the seal 122 and is clamped between the walled enclosure 12 of hopper car 10 and an outer clamp 130. The outer clamp 130 is preferably formed of a rigid material such as steel or the like. In the illustrated form, a plurality of threaded fasteners 132 are used to conjointly secure the outer clamp 130 and the inner frame 126 to the walled enclosure 12 of hopper car 10 with the mounting flange 128 of seal 122 securely clamped therebetween.

As shown in FIG. 13, the mounting flange 128 of seal 122 includes an outwardly projecting lip 134 extending longitudinally therealong. The outer clamp 130 of seal structure 120 is preferably provided with an open longitudinally extending channel 136 configured to accommodate and hold the longitudinally extending lip 134 of seal 122 therewithin. Accordingly, and when the seal 122 is secured to the walled enclosure 12 of hopper car 10 in relation to the discharge opening 40, the lip 134 of seal 122 and channel 136 on the outer clamp 130 cooperate relative to each other to inhibit the seal 122 from being inadvertently pulled or torn from about the discharge opening 40.

Another feature of the present invention relates to the design of the discharge doors 44A and 44B of the plurality of discharge doors 44. As shown in FIGS. 11 and 12, each discharge door 44A, 44B is preferably provided with a vertically upturned lip 140 extending about at least three sides of the respective door. As shown, the upturned lip 140 extends generally parallel and in spaced relation relative to the outer clamp 130 of the seal structure 120. The upturned lip 140 extends for a vertical distance sufficient to inhibit moisture and related debris from passing into the discharge opening 40 when the discharge door 44 is arranged in the closed position thereby inhibiting contamination of the ballast or particulate matter within the enclosure 12. Notably, that side or edge of the discharge door 44 extending parallel to and spaced the furthest distance from the axes 46A and 46B of each of the doors 44A and 44B, respectively, preferably has no upturned lip to avoid interfering with the material flow from the discharge openings 40 when the discharge doors 44 are moved to an open position.

As will be appreciated by those skilled in the art, the longitudinal disposition of the discharge doors 44 allows the particulate matter or ballast to be rapidly discharged from the enclosure 12 after the discharge doors 44 are opened. As mentioned above, it is customary to open loading doors on the roof 32 of the enclosure 12 before the discharge doors 44 of the hopper car 10 are opened to effect pressure equalization within the enclosure 12. As will be appreciated, and for any of several reasons, the loading doors on the roof of the hopper car are not always opened before the discharge doors are opened. Thus, and notwithstanding the rigidity and support added to the enclosure 12 by the vertical stakes or supports 30, the side walls 26, 28 of the enclosure 12 tend to implode upon rapid discharge of material from the enclosure 12 of the hopper car 10.

Figure 15:
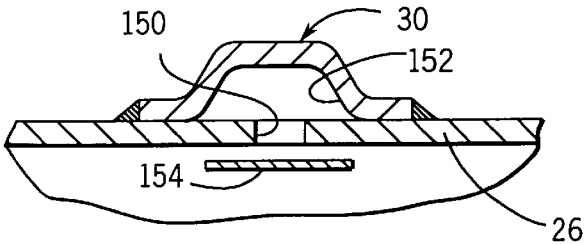
FIG. 15 is a sectional view taken along line 15—15 of FIG. 14.
Figure 14:
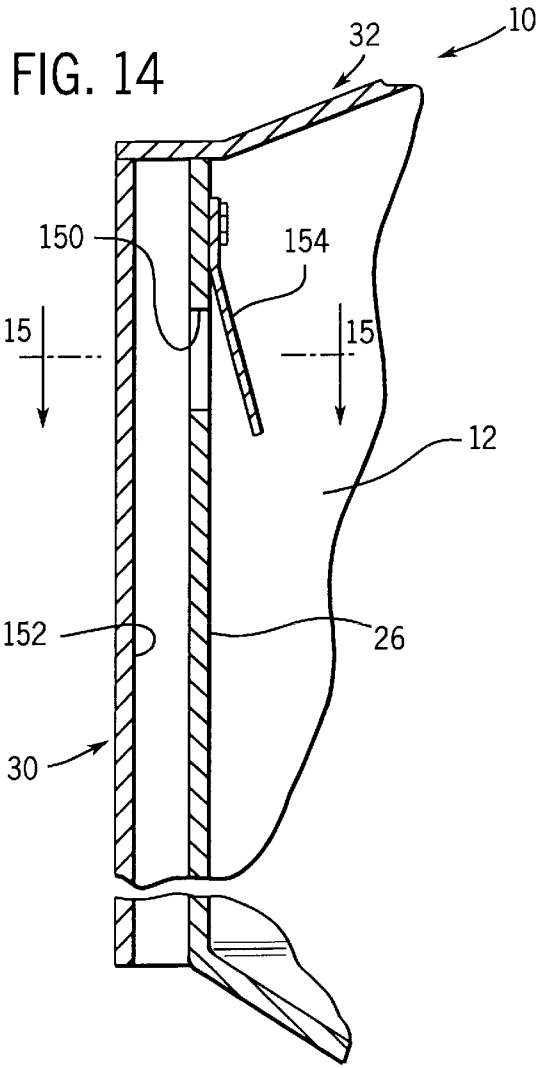
FIG. 14 is an enlarged sectional view taken along line 14—14 of FIG. 1.

Accordingly, the hopper car 10 is furthermore provided with a venting system for automatically effecting pressure equalization within the enclosure 12 of the hopper car 10 as a result of the discharge doors 44 being opened but requiring no operator intervention. In the preferred embodiment, and as shown in FIGS. 14 and 15, the venting system involves using one or more of the vertical stakes or supports 30 as an air plenum for directing ambient air to an inlet opening 150 arranged toward an upper end or top of the enclosure 12 of hopper car 10. Notably, and as shown, each stake or support 30 on opposite side walls 26, 28 of the enclosure 12, defines an elongated channel 152 which, in the illustrated embodiment, is open at the bottom thereof. The open bottom end of the channel 152 permits ambient air to be drawn into the channel and toward the inlet opening 150. Moreover, a deflector 154 is provided on the interior of the walled enclosure 12 to cover the inlet opening 150 while allowing air to be drawn into the enclosure 12 through the opening 150. As will be appreciated, the deflector 154 serves to inhibit particulate matter and material from inadvertently plugging or clogging the inlet opening 150 during loading of the hopper car 10.

Returning to FIGS. 3 and 4, the railroad hopper car 10 furthermore preferably includes deflectors 160 arranged longitudinally along opposed sides 26, 28 of the walled enclosure 12 (FIG. 1). The deflectors 160 act in conjunction with the discharge doors 44A, 44B for limiting the discharge pattern of particulate matter from the hopper car 10. More specifically, the deflectors 160 serve to limit the discharged ballast or particulate matter to a relatively narrow pattern disposed between the laterally spaced wheels 20 of each wheeled truck 18.

During unloading, a covered railroad hopper car 10 according to the present invention, is positioned along the tracks 24. Notably, the longitudinal disposition of the discharge doors 44 along the bottom 38 of the car enhances the carrying capacity of the walled enclosure 12.

Once the railroad hopper car 10 is properly positioned along the tracks 24 for discharge, the door operating mechanism 50 is enabled through any suitable switch or the like (not shown) operably associated therewith. With the first disclosed embodiment of the invention, when the door operating mechanism 50 is enabled, the single driver or actuator 52 is powered to cause the piston rod 62 and the ram 64 associated therewith to linearly distend outwardly away from the cylinder 60. As mentioned above, the linear displacement of the piston rod 62 is converted to rotary or pivotal movement of the actuating shaft or member 54 about axis 56.

As best illustrated in FIG. 7, as the piston rod 62 and ram 64 linearly move away from the cylinder 60, the cam actuator 112 on the secondary lock mechanism 100 will contact the underside of lever 102. As linear movement of the ram 64 continues, the camming action of the actuator 112 on lever 102 will cause the lock lever 102 to pivot and lift about pin 104 against the action of spring 106 thereby lifting or removing the stop pin 105 from engagement with and from the path of travel of the end cap 108 of pivot pin 68 connecting the ram 64 to the actuating lever 66 of the door operating mechanism 50. As will be appreciated by those skilled in the art, in this preferred form, the cam actuator 112 is arranged relative to the underside of the lever 102 such that after the pivot pin 68 traverses the full length of the elongated slot 67 in the ram 64, the locking lever 102 and stop pin 105 are removed from interfering with or otherwise encumbering arcuate movement of the actuating lever 66. That is, the lost motion associated with the secondary lock mechanism 100 through the elongated slot 67 in ram 64 assures the lock mechanism 100 is released in timed relation and, more specifically, prior to movement of the actuating arm or lever 66 in a direction to open the plurality of discharge doors 44.

As will be appreciated from FIGS. 3, 4 and 8, rotation of the actuating shaft 54, resulting from arcuate movement of the actuating lever 64 about axis 56, results in all of the pairs of discharge doors 44A, 44B in the plurality of discharge doors 44 being opened substantially simultaneously to exhaust the particulate matter from the enclosure 12. That is, rather than requiring operators to have to incur three or more separate operations on three or more different discharge gates, the door operating mechanism 50 conjointly opens all three longitudinally spaced and elongated discharge doors 44 at substantially the same time. Thus, substantially the entire bottom 38 of the hopper car 10 is opened at once to permit rapid discharge of material from the enclosure 12.

As shown in FIG. 8, rotation of the actuating shaft 54 about axis 56 as a result of actuation of the single powered driver 52 (FIGS. 6 and 7) produces simultaneous rotation of all the bell crank levers 72 of the linkages 70. As each bell crank lever 72 rotates about axis 56, the links 76, 86 of linkages are moved out of their overcenter locking disposition and move toward the dotted line positions shown in FIG. 8. Accordingly, each pair of discharge doors 44A, 44B of the plurality of discharge doors 44 are pivotally moved about their respective pivot axis 46A and 46B arranged adjacent the longitudinal centerline 16 of the hopper car 10. In a preferred embodiment, the driver 52 of the door operating mechanism 50 remains powered during unloading of the car 10 to assure the discharge doors remain in their open position.

The venting system associated with the hopper car 10 is configured to prevent the walls of the enclosure 10 from imploding during rapid discharge of material from the hopper car 10. As will be appreciated by those skilled in the art, and as a result of the provision of the venting system, during unloading of the hopper car 10 ambient air is drawn through the channels 152 defined by the supports 30 and is introduced toward an upper end of the car 10 through the inlet ports 150 to effect pressure equalization in the enclosure 12. The deflectors 154 arranged across the inlet ports 140, while freely allowing ambient air to be introduced toward an upper end of the car 10, inhibit plugging of the inlet ports 150 during loading of the car 10 as through the roof 32.

In addition to effecting rapid discharge of material from the hopper car 10 with minimal operator intervention, controlling the discharge of particulate matter from the hopper car 10 is also an important concern during the unloading process. As mentioned above, controlling the discharge of material to a limited area preferably extending between the wheels 20 and tracks 24 is an advantageous objective of the present invention. In this regard, having the pairs of discharge doors 44A and 44B of the plurality of discharge doors 44 pivot adjacent to the longitudinal axis 16 of the hopper car 10 advantageously limits the discharge pattern of the particulate matter to an area between the rails 24. In a preferred form, the deflectors 160 arranged along opposed sides of the railcar 10 combine with the discharge doors 44 to furthermore limit the pattern of particulate matter discharged from the car 10 to a relatively narrow area between the laterally spaced wheels 20 of each wheeled truck 18. As such, exposure of the tracks or rails 24 to particulate matter is reduced thereby reducing the likelihood of an inadvertent derailment due to particulate matter contamination of the rails 24. Moreover, the upturned lips 140 arranged about the periphery of each pair of discharge doors 44A, 44B of the plurality of discharge doors 44 furthermore adds a degree of control to the material flowing from the car 10.

After the discharge of matter from the car 10 is completed, the single powered actuator 52 of the door operating mechanism 50 is operated to retract the ram 64 thereby forcibly pulling the actuating lever 66 toward a closed position. Of course, pulling the actuating lever 66 causes the actuating shaft 54 to rotate about axis 56 in a direction causing the linkages 70 to close the discharge doors 44. Notably, and as shown best in FIG. 8, links 76, 86 of each linkage 70 are returned to an overcenter position when the discharge doors 44 are closed thereby reestablishing a primary lock holding the discharge doors 44 in a closed position.

On the return stroke of the pneumatic cylinder 60, the elongated slot 67 of the ram 64 will traverse across the pivot pin 68 of the actuating lever 66 in a lost motion movement and until the pivot pin 68 is constrained by an opposite end of the slot 67 at which time, the actuating lever 66, te pivot pin 68 and ram 64 will move in unison relative to each other. As such, and because the cam actuator 112 is retracted from engaging the underside of the stop lever 102, the spring 106 serves to move the lever 102 into the position shown in FIG. 6 whereby the stop pin 105 is in a position to be engaged by the end cap 108 on pivot pin 68 thereby reestablishing a secondary lock which furthermore inhibits the discharge doors 44 from moving toward their open position if, and for whatever reason, the primary lock should fail. Thus, power to the single powered actuator 52 of the door operating mechanism can be shut off without concern of the discharge doors moving toward an open position from their closed position.

When the discharge doors 44 are in their closed position, the doors 44 press against the seal structure 120 to preferably seal the discharge doors 44 to the enclosure 12. As will be appreciated by those skilled in the art, the threaded connection between the radial arms 74, 84 of each bell crank lever 72 of the linkages 70 and the finely threaded shank portion 94 on the levers 90 of each linkage 70 of the door operating mechanism 50 permits accurate and fine adjustment of the closing or sealing force applied by each discharge door 44 against the seal structure 120. In the illustrated embodiment, the hollow configuration of the seal 122 furthermore enhances the performance of seal structure 120. Moreover, the inner frame 126 of seal structure 120 limits overcompression of the seal 122 and thereby prolongs its usefulness. Additionally, clamping the flange 128 of seal 122 with the outer clamp 130 and to the walled enclosure 12 inhibits the seal 122 from being torn or ripped from the enclosure 12. As will be appreciated, the upturned lip 140 extending about the peripheral edge of the discharge doors 44 furthermore inhibits moisture and debris from contaminating the ballast or particulate matter within the enclosure 12 of the covered hopper car 10 when the discharge doors 44 are in closed position.

Figure 17:
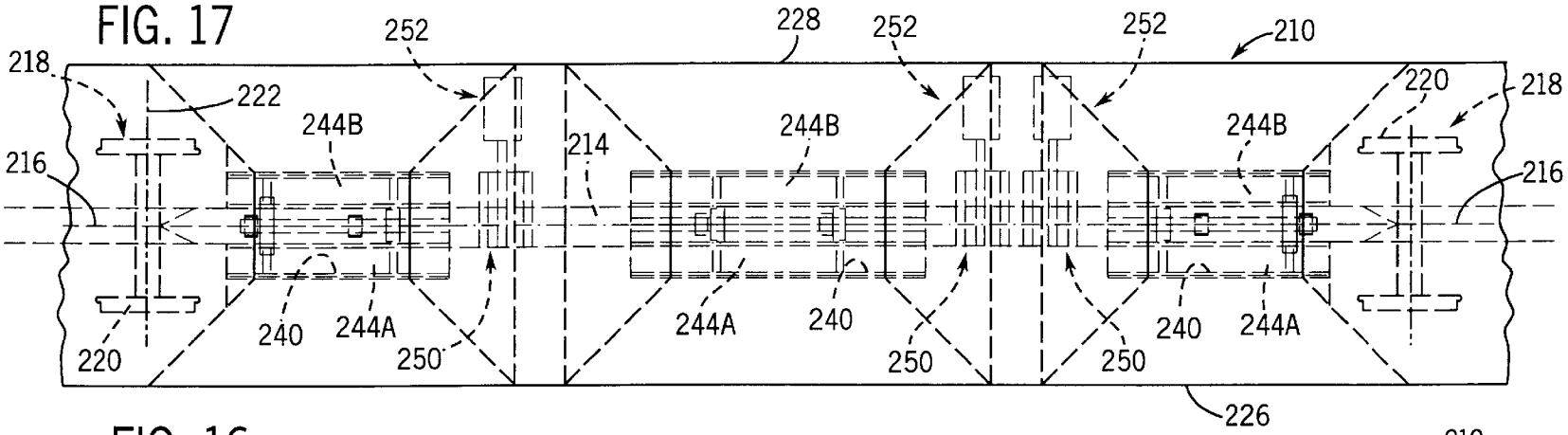
FIG. 17 is a top plan view of the hopper car illustrated in FIG. 16.
Figure 16:
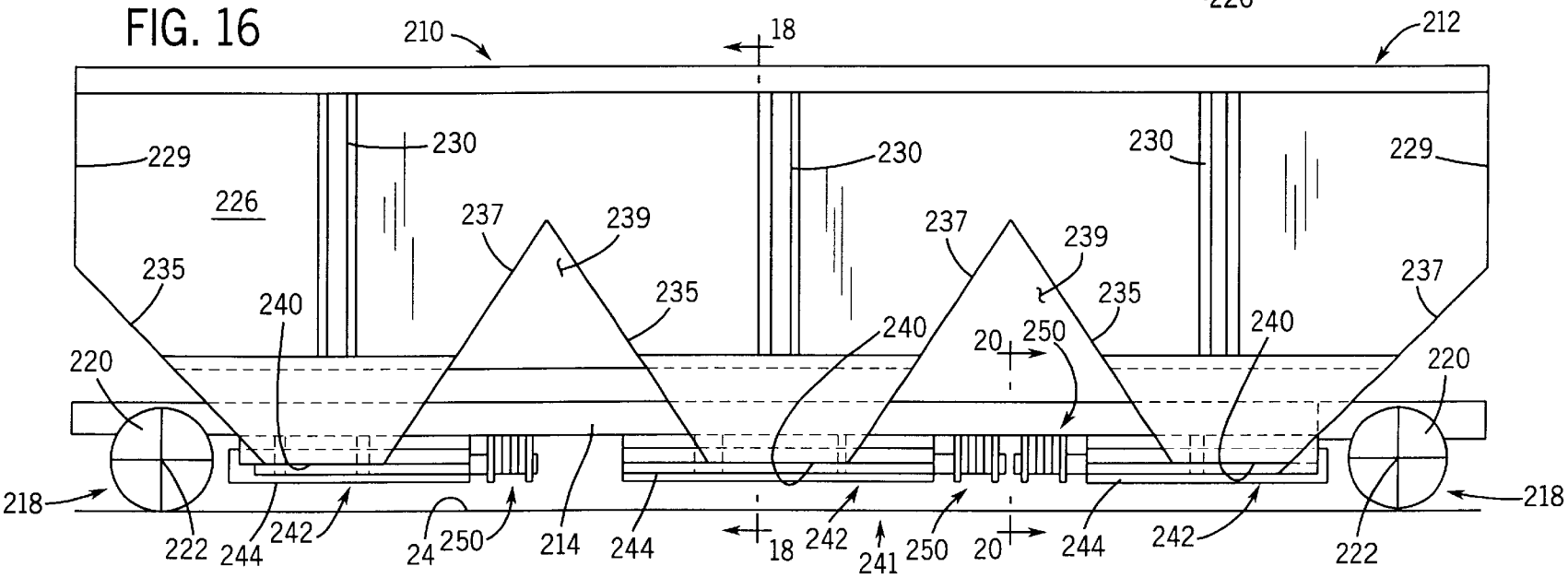
FIG. 16 is a side elevational view of an alternative hopper car design embodying features of the present invention.

An alternative design for a hopper car, equipped with an apparatus including a plurality of discharge door assemblies according to an alternative embodiment of the present invention, is schematically illustrated in FIGS. 16 and 17 for controlling discharge of material from a hopper car. This alternative form of hopper car is designated generally by reference numeral 210. The elements of this hopper car that are identical or functionally analogous to those components discussed above regarding hopper car 10 are designated by reference numerals identical to those used above with the exception that this embodiment uses reference numerals in the 200 series.

The railroad hopper car, generally designated by reference numeral 210, includes a multiwalled enclosure 212 for storing and transporting ballast or particulate matter therewithin. As is known in the art, the multiwalled enclosure 212 is supported on an underframe or centersill 214. The underframe 214 extends generally the length of and generally parallel to the longitudinal axis 216 of the car 210. As is typical, the underframe 214 is supported toward opposite ends thereof by conventional wheeled trucks, generally designated by reference numeral 218. As known in the art, each wheeled truck 218 preferably includes a pair of laterally spaced flanged wheels 220 which turn about an axis 222 extending transverse to the longitudinal axis 216 of the car 210 and which ride on laterally spaced tracks or rails 24.

The enclosure 212 has a generally rectangular configuration toward a top portion thereof and includes laterally spaced generally parallel side walls 226 and 228. As illustrated in FIG. 16, a pair of opposed end walls 229 add to the generally rectangular configuration of the walled enclosure 212. As discussed above, a plurality of vertical side stakes or supports 230 are provided in combination with each side wall 226, 228 to add strength and rigidity thereto.

In this car design, and as illustrated in FIG. 16, a lower end of the car is provided with a plurality of vertically slanted slope sheets 235 and 237 which combine with each other to define a plurality of longitudinally spaced and elongated discharge openings 240 along a bottom 238 of the car 210 for allowing ballast or particulate matter to be discharged from the enclosure 212. As is common in cars of this design, the longitudinally elongated discharge openings 240 are preferably arranged in pairs (FIGS. 18 and 19) relative to each other on opposite lateral sides of the centersill or underframe 214. As best illustrated in FIG. 16, a recess or opening 239 extending laterally across the car 210 is defined between the longitudinally adjacent slope sheets 235 and 237 defining longitudinally adjacent discharge openings 240.

Figure 18:
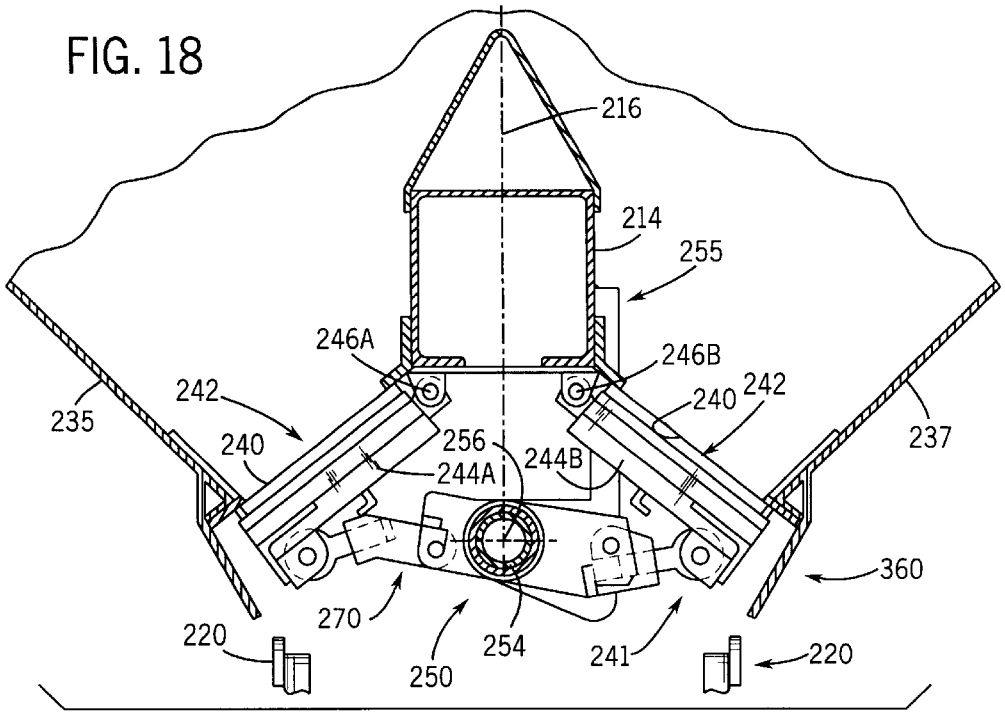
FIG. 18 is a sectional view taken along line 18—18 of FIG. 16 illustrating an alternative form of discharge doors in a closed position.
Figure 19:
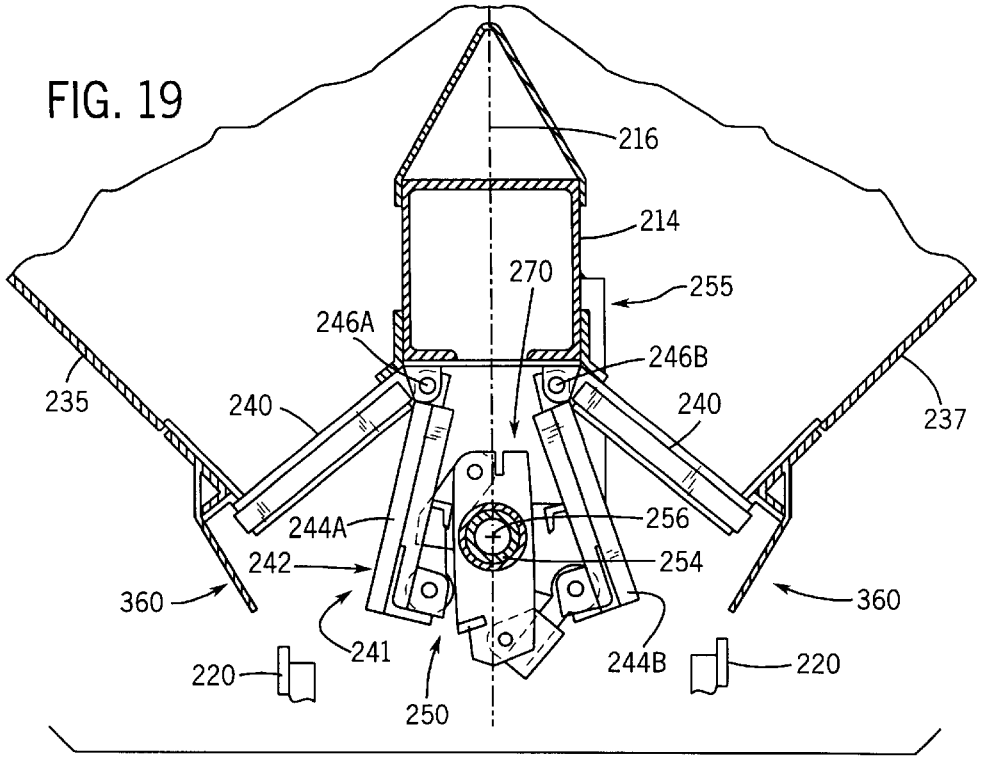
FIG. 19 is a sectional view similar to FIG. 18 but showing the discharge doors in an open position.

According to this embodiment of the present invention, an apparatus or assembly 241 including a plurality of longitudinally disposed door assemblies, with each door assembly being generally designated by reference numeral 242, is shown in FIGS. 18 and 19. As will be appreciated by those skilled in the art, a single door assembly 242 is arranged in operable combination with each discharge opening 240 on the hopper car 210. Preferably, the longitudinally door assemblies 242 of apparatus 241 are substantially similar to another. Accordingly, only one discharge door assembly 242 will be discussed in detail. As shown in FIGS. 17, 18 and 19, each door assembly 242 preferably includes a pair of longitudinally elongated, divergently opening discharge doors 244A and 244B arranged on the hopper car 210 in opposed relation relative to each other. Each pair of doors 244A and 244B is mounted to the hopper car 210 for movement between a closed position or condition (FIG. 18) and an open position or condition (FIG. 19).

As shown in FIGS. 18 and 19, each discharge door 244A and 244B of a discharge door assembly 242 is mounted to the underframe 214 adjacent the longitudinal centerline 216 of the hopper car 210 for pivotal movement. Each door 244A is mounted to the underframe 214 of the hopper car 210 for pivotal movement about a generally horizontal axis 246A disposed generally parallel and adjacent to the longitudinal centerline 216 of the hopper car 210. Similarly, each door 244B is mounted to the underframe 214 of the hopper car 210 for pivotal movement about a generally horizontal axis 246B disposed generally parallel and adjacent to the longitudinal centerline 216 of the hopper car 210.

Unlike the first embodiment of the invention, a door operating mechanism 250 is provided for positively and conjointly operating at least one set of doors 244A and 244B of a door assembly 242 between their open and closed positions independently of operation of the other door assemblies 242 on the hopper car 210. In this alternative form of the invention, each door assembly 242 is provided with an independently operable door operating mechanism 250. It is within the spirit and scope of the present invention, however, to provide a hopper car with three discharge openings each having a discharge door assembly configured according to the present invention operably associated therewith and wherein two of the discharge door assemblies operate in combination relative to each other while the third discharge door assembly operates independently of the other two discharge door assemblies.

Figure 20:
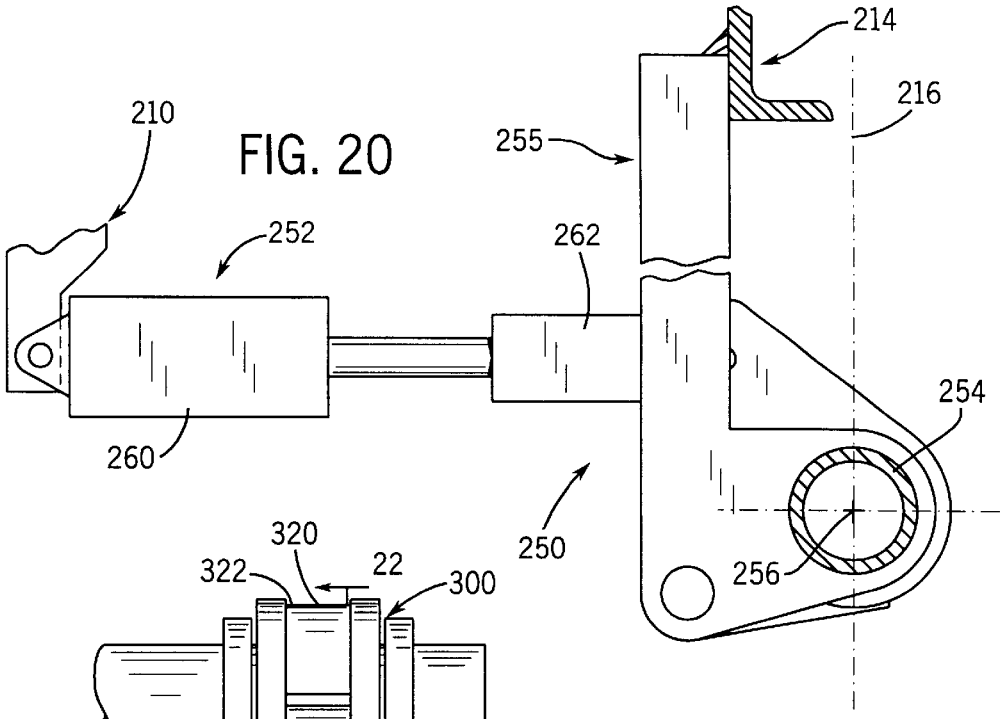
FIG. 20 is an enlarged sectional view taken along line 20—20 of FIG. 16 showing an alternative form of a door operating mechanism for the present invention.

Turning to FIG. 20, each door operating mechanism 250 includes a positively powered driver 252 and an elongated operating or actuating shaft 254 connected to the driver 252. When all the door assemblies 242 on the hopper car 210 are to be operated independently relative to each other, the actuating shaft 254 of each door operating mechanism 250 has a length slightly greater than the longitudinal length of a respective discharge door assembly with which it is operably associated. Of course, and as discussed in the alternative above, in those embodiments wherein two longitudinally adjacent door assemblies are to be operated conjointly, the operating shaft 254 could be readily redesigned to span a longitudinal distance slightly greater than the cumulative longitudinal distance of the two adjacent door assemblies with which the actuating shaft 254 can be associated.

Suffice it to say, the actuating shaft 254 extends generally parallel to the longitudinal axis 216 of the hopper car 210 preferably beneath the centersill 214. Preferably, and as illustrated in FIG. 17, the actuating shaft 254 for each door operating mechanism 250 is supported by a plurality of longitudinally spaced mounting brackets 255. As schematically illustrated in FIG. 20, the brackets 255 serve to position the actuating shaft 254 beneath the centersill 214 of the hopper car 210. Each actuating shaft 254 is supported for rocking or rotational movement about a fixed axis 256 extending generally coplanar with the longitudinal axis 216 of the car 210. To reduce its weight without effecting its strength or rigidity, the actuating shaft 254 preferably has a hollow or tubular configuration.

Figure 21:
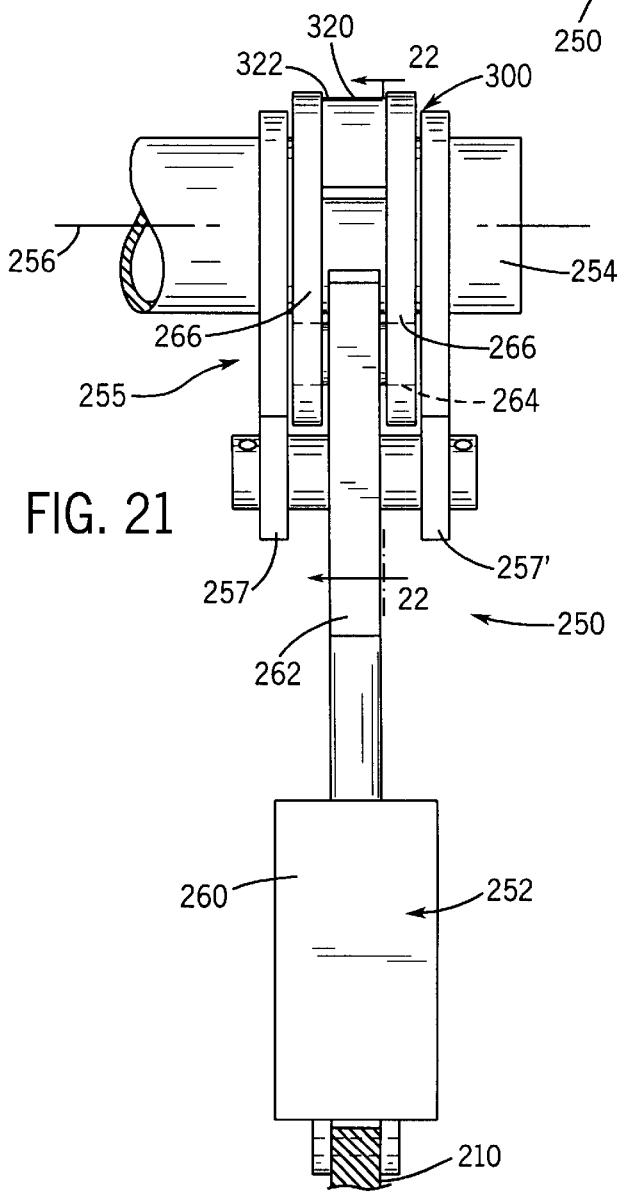
FIG. 21 is a partial top plan view of the door operating mechanism illustrated in FIG. 20.

In the illustrated form of the invention, and as schematically illustrated in FIG. 21, each mounting bracket 255 includes a pair of preferably identical and longitudinally spaced generally L-shaped mounts 257 and 257'. An upper end of each mount 257, 257' is suitably secured to the centersill 214 of the hopper car 210 (FIG. 20).

As will be appreciated by those skilled in the art, the driver 252 can take any suitable form. In the illustrated form of the invention, the driver 252 extends laterally across the hopper car 210 and is generally disposed normal to the longitudinal axis 216 of the hopper car 210. In the illustrated form of the invention, each driver 252 of the door operating mechanism is arranged proximate one end of the door assembly 242 and is preferably accommodated in a recess 239 extending laterally across the car between the adjacent slope sheets 235, and 237 of longitudinally adjacent discharge openings 240.

Figure 22:
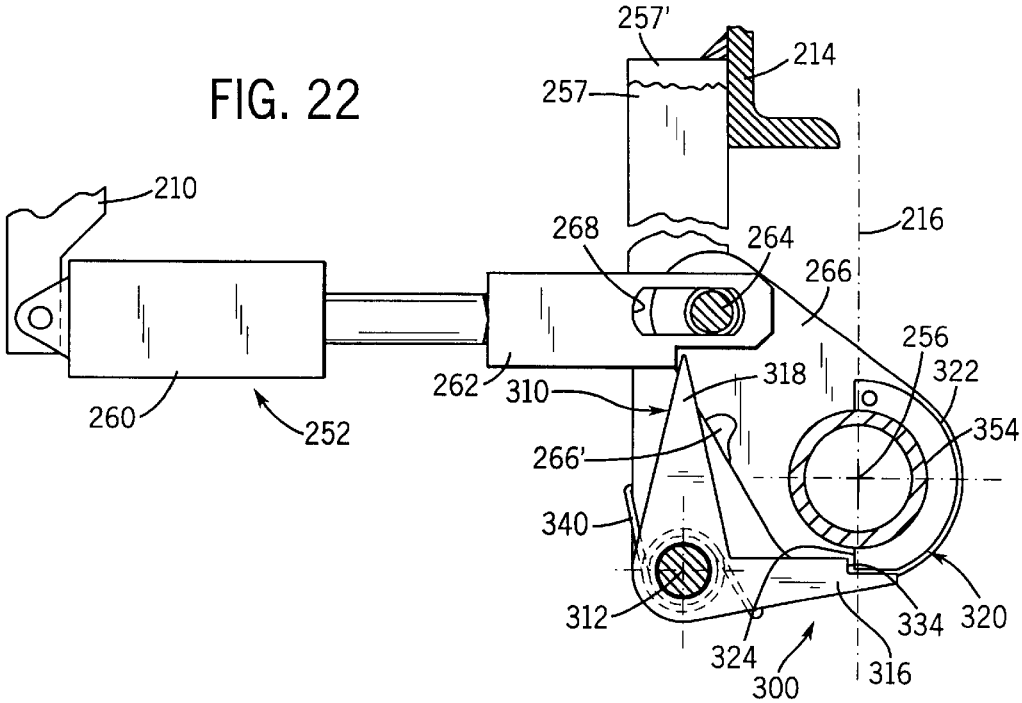
FIG. 22 is a sectional view taken along line 22—22 of FIG. 21 showing the door operating mechanism in a locked condition.

In the preferred embodiment, each driver 252 is configured as a linearly distendable pneumatically operated cylinder 260 with a cylinder end connected at a fixed location to the hopper car 210 and includes a piston rod 262 extending from one end of the cylinder 260. Preferably, the cylinder end of the driver 252 is connected to the hopper car 210 at a fixed location. As illustrated in FIGS. 21 and 22, a distal end of the piston rod 262 is articulately connected, as by a pin 264, to the free ends of a pair of identical levers or drive arms 266 and 266' disposed to opposite sides of the free or distal end of the piston rod 262 of cylinder 260. As such, the distal end of the piston rod 262 moves along a predetermined path of travel.

Each lever or drive arm 266, 266' radially extends outwardly from and is connected to the actuating shaft 254 of a respective door operating mechanism 250. As illustrated in FIG. 21, the drive arms 266, 266' are preferably disposed between the mounts 257, 257' of the mounting bracket 255 in alignment with the distendable path of the driver 252.

In the form illustrated in FIG. 22, the distal end of the piston rod 262 of driver 252 has an elongated slot or opening 268 through which pin 264 passes. Accordingly, and for purposes discussed in detail below, the driver 252 has a predetermined degree or amount of lost motion as the pin 264 traverses between opposite ends of the slot 268 upon reciprocation of the driver 252. As will be appreciated from an understanding of the present invention, linear reciprocal movement of the driver 252 is converted to rocking movement of the actuating shaft 254 about axis 256.

Returning to FIGS. 18 and 19, each door operating mechanism 250 furthermore includes a plurality of longitudinally spaced linkages 270 for operably connecting the actuating shaft 254 of each door operating mechanism 250 to the pair of doors 244A and 244B of each respective door assembly 242. Preferably, the linkages 270 of each door operating mechanism 250 are substantially similar to each other. Moreover, the linkages 270 are substantially similar to the linkages 70 discussed in detail above. Suffice it to say, and as discussed in detail above, the linkages 270 are configured as an overcenter mechanism and also serve as a primary lock for maintaining the discharge doors 244A and 244B of a respective discharge door assembly 242 in a releasably closed position or condition.

Figure 23:
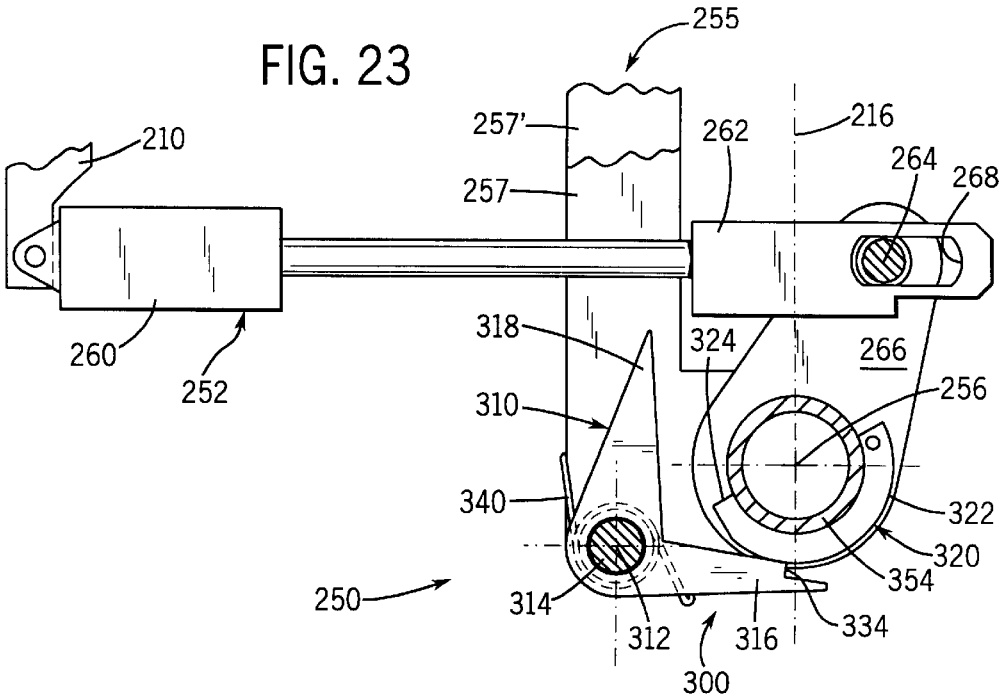
FIG. 23 is a sectional view similar to FIG. 22 but showing the door operating mechanism in an unlocked condition.

Preferably, each door operating mechanism 250 furthermore includes a secondary lock mechanism, generally designated in FIGS. 22 and 23 by reference numeral 300. The primary purpose of the secondary lock mechanism 300 is to prevent the doors 244A, 244B from opening upon inadvertent failure of the primary lock during operation of the railroad hopper car 210. An added advantage realized with the design of the lock mechanism 300 is that the weight applied to either door 244A, 244B by the material in the enclosure 212 is advantageously shifted to the centersill 214.

As will be appreciated by those skilled in the art, the lock mechanism 300 can take a myriad of different designs for effecting the primary purpose described above without detracting or departing from the spirit and scope of the present invention. As illustrated in FIG. 22, the lock mechanism 300 includes a lock lever 310 preferably mounted between the drive arms 266 and 266' for pivotal or rocking movement about a fixed axis 312 defined by a pin or stub shaft 314 carried by and extending between the mounts 257, 257' of the mounting bracket 255. In the preferred form, the lock lever 310 of lock mechanism 300 is generally centrally disposed between the drive arms 266 and 266'. As shown, lock lever 310 includes a pair of arms 316 and 318 extending in angularly divergent radial direction away from axis 312. As will be appreciated by those skilled in the art, the size or dimension of the lock lever 310 is proportional to the effective length of the drive arms 266, 266' measured between shaft 254 and pin 264.

The illustrated form of lock mechanism 300 furthermore includes a lock 320. Lock 320 preferably spans the distance between the drive arms 266, 266' and comprises a radial extension of shaft 254 having an outer circumferential surface 322. Notably, in this form of lock mechanism, lock 320 is affixed to and, thus, rotates with the actuating shaft 254. A lower terminal end of lock 320 is defined by a generally flat radial shoulder 324 extending radially away from the outer diameter of shaft 254 to the outer diameter of surface 322.

Returning to FIG. 22, a lengthwise portion of arm 316 of lock lever 310 is configured to extend, for a relatively short distance, beneath and engage the circumferential surface 322 of lock lever 310. As shown, arm 316 defines a notch or step 334 which is configured to engage with the shoulder 324 on the lock 320 thereby preventing rotational movement of the shaft 254 in a direction permitting opening of the doors 244A and 244B of a respective door assembly 242 thereby releasably holding the doors 244A and 244B of the respective door assembly 242 in a closed position or condition.

A preferred form of lock mechanism 300 is configured to allow for automatic operation of the lock mechanism 300 when the doors 244A and 244B of a respective door assembly 242 return to their closed position or condition from an open position or condition. To effect these ends, the lock lever 310 is biased toward a locked condition with the lock 320. Of course, a varied assortment of mechanisms could be used to bias the lock lever 310 into a locked condition with the lock 320. In the illustrated form, a torsion spring 340 fitted about and along the stub shaft or pin 314 provides the force necessary to bias the lock lever 310 into locked engagement with the lock 320. As will be appreciated, one end of torsion spring 340 can be secured to the mounting bracket 255 while the other end of the spring 340 can operably engage the lock lever 310 in a manner biasing the lock lever 310 into a releasably locked engagement with the lock 320.

In the illustrated form of lock mechanism 300 shown in FIG. 22, arm 318 is configured such that at least a lengthwise portion thereof lies in the predetermined path of travel of the distal end of the piston rod 262 of driver 252. As such, and upon linear distention of the driver 252, the lock lever 310 is forcibly rotated or pivoted about the axis 312 of stub shaft 314 against the bias of spring 340 (FIG. 23).

In a preferred form, each door 244A and 244B of a door assembly 242 further includes seal structure arranged in combination therewith for effectively sealing closed a respective discharge door to the walled enclosure 212 of the hopper car 210. The seal structure associated with each discharge door assembly 242 is preferably configured like that discussed above with respect to seal structure 120. Accordingly, no further detail need be provided for a proper and full understanding of same.

Moreover, and as illustrated in FIGURE hopper car 210 can be provided with a venting system for automatically effecting substantial pressure equalization within the enclosure 212 on the hopper car 210 as a result of the discharge doors being opened but requiring no operator intervention. The venting system is similar to that illustrated and discussed in detail above in connection with hopper car 10. Accordingly, no further details need be provided for a proper and full understanding of same.

The hopper car 210 can also be provided with deflectors 360 arranged longitudinally along opposed sides 226, 228 of the walled enclosure 212. The purpose and design of the deflectors 360 is similar to that discussed above in connection with deflectors 160. Accordingly, no further details need be provided for a proper and complete understanding of same.

During unloading, the railroad car 210 is positioned along the tracks 24. Once the railroad car 210 is properly positioned along the tracks 24 for discharge, any one of the door assemblies 242 can be operated. That is, with this second embodiment of the invention, and depending on the configuration of the door operating mechanism 250, one or more of the door assemblies 242 can be operated to effect discharge of material from the hopper car 210 independently of the other discharge door assembly on the hopper car 210.

According to this alternative embodiment of the invention, and to effect discharge of material from the hopper 212, a door operating mechanism 250 is enabled in response to operation of the driver 252. As will be appreciated, the driver 252 of the door operating mechanism can be readily and conveniently operated through any suitable switch or the like (not shown) operably associated therewith. In this alternative form of the invention, and as seen from comparing FIGS. 22 and 23, activation of the driver 252 results in the distention of the distal end 262 of the driver 252 along a predetermined path of travel. Moreover, with this form of the invention, activation of the driver 252 results in the secondary lock 300 being automatically released in timed relation to opening of the doors 244A and 244B of the respective discharge door assembly 242.

As best illustrated in FIG. 22, upon activation of driver 252, the piston rod 262 linearly moves away from the cylinder 260 and the secondary lock 300 is automatically released. In this form, as the piston rod 262 linearly moves away from the cylinder 260, the lost motion associated with the door operating mechanism 250 collapses. That is, in the form of the door operating mechanism illustrated in FIG. 22, as the piston rod 262 moves away from the cylinder 260, the pin 264 traverses from one end of slot or opening 268 to the other. As such, no rotary motion is imparted to the drive levers 266, 266' or to the actuating shaft 254.

Linear distention of the driver 252, however, does cause the piston rod 262 to engage the free end of arm 318 of lock lever 310 thereby forcibly rocking the lock lever 3 10 in a rotational clockwise direction (as seen in FIGS. 22 and 23). As the lock lever 310 rotates, the step 334 on lock lever 310 is released from engagement with the shoulder 324 on lock 320 thereby disabling the lock 300 by releasing the locking relationship between lock lever 310 and lock 320.

With lock 300 released, and as linear movement of the driver 252 continues, the distal end of the driver 252 will cause the drive levers 266, 266' and thereby the actuating shaft 254 to rotate. As will, be appreciated from the above, the lost motion associated with the door operating mechanism 250 assures the lock mechanism 300 will be released in timed relation and, more specifically, prior to movement of the actuating shaft 254 in a direction to open the doors 244A and 244B of the respective door assembly 240. Notably, the bias applied to the lock lever 310 maintains arm 316 of lock lever 310 in continuous engagement with the circumferential surface 322 of the lock 322 as linear movement of the driver 252 continues.

As will be appreciated from FIGS. 18 and 19, rotation of the actuating shaft 254, resulting from arcuate movement of the drive levers 266, 266' about axis 256, results in operation of the linkages 270 opening the respective door assembly 240 in the same manner discussed above with respect to linkage 70. Accordingly, the doors 244A and 244B of the respective discharge door assembly 242 are pivotally and simultaneously moved about their respective pivot axis 246A and 246B arranged adjacent the longitudinal centerline 216 of the hopper car 210. In a preferred embodiment, the driver 252 of the door operating mechanism 250 remains enabled during unloading of the car to assure the doors 244A and 244B remain in their open position.

After the discharge of material from hopper 212 is complete, the driver 252 for the door operating mechanism used to open one or more of the discharge door assemblies 242 is again operated to retract the distal end of the piston rod 262 toward the cylinder 260 thereby forcibly pulling the actuating or drive lever 266, 266' toward a closed position. Of course, pulling the drive levers 266, 266' toward a closed position causes the actuating shaft 254 to rotate in a direction causing linkages 270 to close the discharge doors 244A and 244B of a respective discharge door assembly 242. Ultimately, linkages 270 are returned to an overcenter position when the doors 244 are closed thereby locking the doors 244 in a closed condition. Thus, power to the powered actuator 252 of the door operating mechanism 250 can be shut off without concern of the discharge door assembly moving toward an open position from its closed position.

On the return stroke of the driver 252, the elongated slot or opening 268 at the distal end of the piston rod 262 will traverse across the pin 264 until the pin 264 is constrained by an opposite end of the slot 268. As such, the lost motion connection between the driver 252 and the drive levers 266, 266' is reestablished.

When the doors 244A and 244B of the respective discharge door assembly 242 are returned to their closed position, the lock lever 310 assumes the position illustrated in FIG. 22. That is, when the doors 244A and 244B of the respective discharge door assembly 242 are closed, the predetermined path of travel of the piston rod 262 of driver 252 is such that the free end of arm 318 lock lever 310 is biased counter clockwise (as seen in FIGS. 22 and 23) whereby allowing the step or notch 334 on the lock lever 310 to be biased into locked engagement with the shoulder 324 on the lock 320 thereby preventing rotational movement of the shaft 254 in a direction permitting the doors 244A and 244B to open. As will be appreciated, therefore, if the primary lock for the discharge door assembly 242 should fail, the secondary lock 300 will serve to inhibit the door assembly 242 from opening. Moreover, this alternative design of the secondary lock 300 advantageously transfers the forces applied to the lock 300 to the centersill 214 of the car 210.

From the foregoing, it will be observed that numerous modifications and variations can be effected without departing from the true spirit and scope of the novel concept of the present invention. It will be appreciated that the present disclosure is intended to set forth only exemplifications of the invention, which are not intended to limit the invention to the specific embodiments illustrated and described. The disclosure is intended to cover by the appended claims all such modifications as fall within the spirit and scope of the claims.

What is claimed is:

1. An apparatus for controlling discharge of material from a bottom dump railroad hopper car having an underframe defining a longitudinal axis for the hopper car, a hopper mounted on said underframe for holding material therewithin, said hopper defining a plurality of longitudinally spaced discharge openings through which material is discharged from said hopper, said apparatus comprising:

a plurality of longitudinally mounted discharge door assemblies, each longitudinally mounted discharge door assembly being arranged in cooperative relationship relative to a discharge opening on said hopper to control flow of material from said hopper, and wherein said discharge door assembly comprises a longitudinally disposed discharge door mounted on said hopper for pivotal movement relative to a discharge opening on said hopper car between open and closed positions about an axis arranged adjacent and extending generally parallel to the longitudinal axis of said underframe such that said door is pushed into the closed position and pulled toward the open position; and a door operating mechanism including a positively operated driver carried on said hopper car for operating at least one of said discharge door assemblies independently of at least one other discharge door assembly on the hopper car.

2. The apparatus according to claim 1 wherein the driver of said door operating mechanism extends generally transverse to the longitudinal axis of said hopper car.

3. The apparatus according to claim 1 wherein said door operating mechanism includes an actuating shaft extending generally parallel to the longitudinal axis of said hopper car, and wherein said actuating shaft is only slightly longer than a longitudinal length of said discharge door and is operably connected to said positively operated driver, said actuating shaft being mounted on the underframe of said hopper car for pivotal movement about a fixed axis.

4. The apparatus according to claim 3 wherein said actuating shaft of said door operating mechanism is operably connected to the discharge door of said discharge door assembly through a linkage radially extending outwardly from said actuating shaft and including multiple interconnected links.

5. The apparatus according to claim 4 wherein said linkage is configured as an overcenter linkage mechanism which serves to releasably lock said discharge door assembly from inadvertently opening from the closed position, and whereby mounting each door for pivotal movement about an axis arranged adjacent to the longitudinal axis of said underframe enhances the locking capability of the overcenter linkage after said door is moved to the closed position.

6. The apparatus according to claim 5 wherein said door operating mechanism furthermore includes a secondary lock for maintaining said discharge door assembly in the closed position upon failure of said overcenter mechanism to maintain said door assembly in the closed position.

7. The apparatus according to claim 1 further including a second door operating mechanism having a positively operated driver carried on said hopper car for operating another of said discharge door assemblies independently of said at least one discharge door assembly on the hopper car.

8. An apparatus for controlling discharge of material from a bottom dump railroad hopper car having an underframe defining a longitudinal axis for the hopper car, a hopper mounted on said underframe for holding material therewithin, said hopper defining a plurality of longitudinally spaced discharge openings through which material is discharged from said hopper, said apparatus comprising:

a plurality of longitudinally mounted discharge door assemblies, each longitudinally mounted discharge door assembly being arranged in cooperative relationship relative to a discharge opening on said hopper to control flow of material from said hopper, and wherein said discharge door assembly comprises a pair of longitudinally mounted, divergently opening discharge doors carried on said hopper on opposite lateral sides of said longitudinal axis for pivotal movement relative to a discharge opening on said hopper car between open and closed positions, with each discharge door being arranged for movement about an axis disposed adjacent and extending generally parallel to the longitudinal axis of said underframe such that said discharge doors are pushed into their closed position and pulled toward their open positions; and a door operating mechanism including a positively operated driver carried on said hopper car for simultaneously operating both discharge doors of at least one of said discharge door assemblies independently of at least one other discharge door assembly on the hopper car.

9. The apparatus according to claim 8 wherein the driver of said door operating mechanism extends generally transverse to the longitudinal axis of said hopper car.

10. The apparatus according to claim 8 wherein said door operating mechanism includes an actuating shaft extending generally parallel to the longitudinal axis of said hopper car, and wherein said actuating shaft is only slightly longer than a longitudinal length of a pair of said discharge doors and is operably connected to said positively operated driver, said actuating shaft being mounted on the underframe of said hopper car for rocking movement about a fixed axis.

11. The apparatus according to claim 10 wherein said actuating shaft of said door operating mechanism is operably connected to both discharge doors of said discharge door assembly through linkages radially extending outwardly from said actuating shaft, and wherein each linkage includes multiple interconnected links.

12. The apparatus according to claim 11 wherein each linkage is configured as an overcenter linkage mechanism which serves to releasably lock said discharge door assembly from inadvertently opening from the closed position, and whereby mounting the doors of each discharge door assembly for pivotal movement about an axis arranged adjacent to the longitudinal axis of said underframe enhances the locking capability of the respective overcenter linkage after said door is moved to the closed positions.

13. The apparatus according to claim 12 wherein said door operating mechanism furthermore includes a secondary lock for maintaining said discharge door assembly in the closed position upon failure of said overcenter mechanism to maintain the doors of said door assembly in the closed position.

14. The apparatus according to claim 13 wherein said secondary lock is configured to transfer forces applied thereto through the doors of the discharge door assembly to the underframe of the railroad car.

15. The apparatus according to claim 8 further including a second door operating mechanism having a positively operated driver carried on said hopper car for operating another of said discharge door assemblies independently of said at least one discharge door assembly on the hopper car.

16. A door assembly for a bottom dump railroad hopper car having a centersill defining a longitudinal axis for the hopper car, said door assembly comprising:

a pair of longitudinally mounted, divergently opening discharge doors mountable to said hopper car on opposite lateral sides of said longitudinal axis for pivotal movement relative to a discharge opening on said hopper car between open and closed positions to control flow of material from said hopper, with each discharge door being arranged for pivotal movement about an axis disposed adjacent and extending generally parallel to the longitudinal axis of said centersill on said hopper car that each door is pushed into the closed position and pulled toward the open position; and a door operating mechanism including a positively operated driver mountable to said hopper car in transverse relation relative to the longitudinal axis of the car for simultaneously operating both discharge doors.

17. The door assembly according to claim 16 wherein said door operating mechanism further includes an actuating shaft extending generally parallel to the longitudinal axis of said hopper car for a distance only slightly longer than a longitudinal length of said discharge doors and which is operably connected to said driver.

18. The discharge door assembly according to claim 17 wherein said actuating shaft of said door operating mechanism is operably connected to both discharge doors of said door assembly through linkages radially extending outwardly in opposite radial directions from said actuating shaft, with each linkage including multiple interconnected links.

19. The door assembly according to claim 18 wherein the links of each linkage are interconnected so as to define an overcenter linkage mechanism when said door is in the closed position, with the overcenter linkage design serving to releasably lock said discharge doors from inadvertently opening from the closed position, and whereby mounting the doors of each discharge door assembly for pivotal movement about an axis arranged adjacent to the longitudinal axis of said underframe enhances the locking capability of the respective overcenter linkage after said door is moved to the closed position.

20. The door assembly according to claim 19 wherein said door operating mechanism furthermore includes a secondary lock for maintaining both discharge doors in their closed positions upon failure of said overcenter mechanism to maintain the discharge doors in their closed positions.

21. A railroad hopper car comprising:

an underframe defining a longitudinally axis for said railroad hopper car;

a walled enclosure carried by said underframe and wherein particulate material is transported and held, said walled enclosure defining a plurality of longitudinally spaced discharge openings extending along a bottom of the walled enclosure, with angularly extending slope sheets extending upwardly from said discharge openings to define spaces extending transversely across the longitudinal axis and opening to opposite lateral sides of the car;

a plurality of longitudinally mounted discharge door assemblies arranged in combination with said walled enclosure and in relation relative to said discharge openings to control the discharge of material from the car as a function of the position of the door assembly between open and closed, with each discharge door assembly including a pair of discharge doors arranged on opposite lateral sides of the longitudinal axis of said railroad hopper car, and wherein each discharge door is mounted to the underframe for movement about a pivot axis disposed adjacent and extending generally parallel to the longitudinal axis of the hopper car such that said discharge doors are pushed into their closed position and pulled toward their open positions;

a door operating mechanism including a positively operated driver carried on said hopper car for simultaneously operating both discharge doors of at least one of said discharge door assemblies independently of at least one other discharge door assembly on the hopper car.

22. The hopper car according to claim 21 wherein said door operating mechanism includes an actuating shaft extending generally parallel to the longitudinal axis of said hopper car, and wherein said actuating shaft is only slightly longer than a longitudinal length of a pair of said discharge doors and is operably connected to said positively operated driver, said actuating shaft being mounted on the underframe of said hopper car for rocking movement about a fixed axis.

23. The hopper car according to claim 22 wherein said actuating shaft of said door operating mechanism is operably connected to both discharge doors of said discharge door assembly through linkages radially extending outwardly from said actuating shaft, and wherein each linkage includes multiple interconnected links.

24. The hopper car according to claim 23 wherein said each linkage radially extending from said actuating shaft is configured as an overcenter linkage mechanism which serves to releasably lock said discharge door assembly from inadvertently opening from the closed position, and whereby mounting the doors of each discharge door assembly for pivotal movement about an axis arranged adjacent to the longitudinal axis of said underframe enhances the locking capability of the respective overcenter linkage after said door is moved to the closed position.

25. The hopper car according to claim 24 wherein said door operating mechanism furthermore includes a secondary lock for maintaining said discharge door assembly in the closed position upon failure of said overcenter mechanism to maintain the doors of said door assembly in the closed position.

26. The hopper car according to claim 21 further including a second door operating mechanism having a positively operated driver carried on said hopper car for operating another of said discharge door assemblies independently of said at least one discharge door assembly on the hopper car.

* * * * *